US006074169A

United States Patent [19]

Siga et al.

[11] Patent Number: 6,074,169

[45] Date of Patent: Jun. 13, 2000

[54] HIGH AND LOW PRESSURE SIDES-INTEGRATING STEAM TURBINE, LONG BLADES THEREOF AND COMBINED CYCLE POWER GENERATION SYSTEM

[75] Inventors: Masao Siga, Hitachiota; Takeshi Onoda, Hitachi; Shigeyoshi Nakamura, Hitachinaka; Ryo Hiraga, Hitachiota, all of Japan

[73] Assignee: Hitachi, Ltd., Tokyo, Japan

[21] Appl. No.: 08/934,665

[22] Filed: Sep. 22, 1997

[30] Foreign Application Priority Data

Sep. 24, 1996 [JP] Japan ..... 8-251200

[51] Int. Cl.[7] ..... C22C 38/44

[52] U.S. Cl. ..... 416/241 R; 415/200; 415/216.1

[58] Field of Search ..... 416/241 R; 415/108, 415/198.1, 199.4, 199.5, 200, 216.1

[56] References Cited

U.S. PATENT DOCUMENTS

| | | | |
|---|---|---|---|
| 4,497,670 | 2/1985 | Siga et al. | 148/12 R |
| 4,850,187 | 7/1989 | Siga et al. . | |
| 5,108,699 | 4/1992 | Bodnar et al. | 148/12 R |
| 5,383,768 | 1/1995 | Siga et al. | 416/241 R |
| 5,520,512 | 5/1996 | Walker et al. | 415/199.5 |
| 5,536,146 | 7/1996 | Siga et al. | 416/241 R |
| 5,749,228 | 5/1998 | Shiga et al. | 60/679 |
| 5,839,267 | 11/1998 | Schonewald et al. | 60/39.02 |

FOREIGN PATENT DOCUMENTS

| | | |
|---|---|---|
| 298127 | 1/1989 | European Pat. Off. . |
| 384181 | 8/1990 | European Pat. Off. . |
| 867522 | 9/1998 | European Pat. Off. . |

OTHER PUBLICATIONS

Thomas C. Elliott, "Standard Handbook of Powerplant Engineering, 2nd Edition," McGraw–Hill, New York, pp. 3–1 through 3–51, Oct. 1997.

*Primary Examiner*—Edward K. Look
*Assistant Examiner*—Matthew T. Shanley
*Attorney, Agent, or Firm*—Beall Law Offices

[57] ABSTRACT

A high and low pressure sides integrating steam turbine having high and low pressure sides integrating steam turbine blades, each made of a martensite steel including 8–13 wt % Cr, and having a blade length of 33 inches or more for 60 Hz power generation and 40 inches for 50 Hz power generation.

10 Claims, 19 Drawing Sheets

HIGH AND LOW PRESSURE SIDES-INTEGRATING STEAM TURBINE, LONG BLADES THEREOF AND COMBINED CYCLE POWER GENERATION SYSTEM

BACKGROUND OF THE INVENTION

The present invention relates to long blades for a high and low pressure sides-integrated steam turbine, using a noble heat resistant alloy, a high and low pressure integral steam turbine using the long blades, and a combined cycle power generation system.

At present, 12Cr—Mo—Ni—V—N steel is used for steam turbine blades. In recent years, it has been desired to raise the thermal efficiency of a fossil fuel power plant in view of energy-saving, and make apparatuses used therefore compact in view of space-saving.

Elongation of the turbine blades is an effective means for improving the thermal efficiency and making the apparatuses compact. Therefore, the length of blades of the final stage tends to be increased year by year. Thereby, under conditions which the steam turbine blades are used also become severe, a conventional 12Cr—Mo—Ni—V—N steel can not provide turbine blades having sufficient strength. Therefore, a stronger material is necessary. Accordingly, the strength of material for long blades, tensile strength, which is a base of mechanical property, is required.

Further, toughness also is required to securing safety against rupture.

As a structural material having a higher tensile strength than the conventional 12Cr—Mo—Ni—V—N steel (martensite steel), a Ni-base alloy and Co-base alloy are known well. However, they are not sufficient in hot workability, machine-cutting property and vibration-attenuating properties, so that they are not desirable.

Material for gas turbine discs is disclosed in JP A 63-171856. Such material, however, does not have a high tensile strength.

Further, an integral turbine, which has a high pressure which and a low pressure side are integrated into one unit in view of space-saving in turbines of a small capacity less than 100,000 kW and a middle capacity of from 100,000 to 300,000 kW, has been put into practice. The length of final stage blades of this integral turbine is 33.5 inches at most because the strength of material the rotor and blade is limited. The blade length, however, is desired to be further elongated in order to increase the turbine output.

JP A 3-130502 discloses blades for high and low pressure sides-integrated steam turbines, using 12% Cr steels. However, the steel is too low in tensile strength to provide long blades for recent low pressure steam turbines.

SUMMARY OF THE INVENTION

An object of the invention is to provide blades of a high and low pressure side-integrating steam turbine, using martensite steel having a high tensile strength, a high and low pressure side-integrating steam turbine using the blades, and a combined cycle power generation system.

The present invention resides in a high and low pressure side-integrating steam turbine for 50 Hz power generation, which has long blades, each made of martensite stainless steel comprising 8–13wt % Cr, and having a blade length of not less than 40 inches, preferably not less than 43 inches.

The present invention also resides in a high and low pressure sides-integrating steam turbine for 60 Hz power generation, which has long blades, each made of the above-mentioned martensite stainless steel, and having blade length of not less than 33 inches, preferably, not less than 35 inches.

The above-mentioned martensite stainless steel, preferably, comprises, by weight percentage, 0.08–0.18% C, not more than 0.25% Si, not more than 1.00% Mn, 8.0–13.0% Cr. more than 2.1% and not more than 3% Ni, 1.5–3.0% Mo, 0.05–0.35% V, 0.02–0.20% in total of at least one kind of Nb and Ta, and 0.02–0.10% N.

Further, the invention resides in a high and low pressure sides-integrating steam turbine which has a rotor shaft made of martensite heat resistant steel comprising, by weight percentage, 0.18–0.28% C, not more than 0.1% Si, 0.1–0.3% Mn, 1.5–2.5% Cr, 1.5–2.5% Ni, 1– 2% Mo, 0.1–0.35% V and not more than 0.003% O, and having a 538° C. $10^5$ h flatness and notch creep rupture strength of not less than 13 kg/mm$^2$ at a high pressure side, a tensile strength of not less than 84 kg/mm$^2$ at a low pressure side and s 50% fracture appearance transition temperature (FATT) of not more than 35° C., and the above-mentioned long blades each planted or mounted on the rotor shaft and having tensile strength of not less than 128.5 kg/mm$^2$.

The present invention resides in a steam turbine for 50 Hz power generation, which is provided with a rotor having blades planted on a mono-block rotor shaft in multi-stages from a high steam pressure side to a low steam pressure side, wherein an inlet temperature of steam to first stage blades is not less than 530° C., the mono-block rotor shaft is made of a Ni—Cr—Mo—V low alloy steel of bainitic structure having a higher strength at the high pressure side than at the low pressure side, or a higher toughness at the low pressure side than at the high pressure side, and the blades of at least a final stage each have a length of not less than 40 inches, preferably, not less than 43 inches and are made of martensite stainless steel including 8–13 wt % Cr. or a steam turbine for 60 Hz power generation, which has the blades of at least a final stage each having a length of not less than 33 inches, preferably, not less than 35 inches and made of martensite stainless steel including 8–13 wt % Cr.

The present invention resides in a combined cycle power generation system in which a generator is driven by a steam turbine and gas turbine, wherein the steam turbine comprises a rotor having blades planted on a mono-block rotor shaft in multi-stages from a high steam pressure side to a low steam pressure side and a casing covering the rotor, an inlet temperature of steam to first stage blades being not less than 530° C., and wherein the rotor shaft is made of a Ni—Cr—Mo—V low alloy steel of bainitic structure having a higher strength at the high steam pressure side than at the low steam pressure side or a higher toughness at the low steam pressure side than at the high steam pressure side, a 538° C. $10^5$ h creep rupture strength of not less than 12 kg/mm$^2$ at a central portion planting or mounting thereon first stage blades at the high steam pressure side or FATT of not more than 20° C. at a central portion planting final stage blades at the low steam pressure side having a room temperature V-notch impact value of not less than 4 kg-m, and blades of at least a final stage among the above-mentioned blades have a value of (blade length (inches)×revolution number (rpm)) of not less than 120,000 and are made of martensite stainless steel including 8–13 wt % Cr.

The present invention resides in a combined cycle power generation system in which a generator is driven by a steam turbine and gas turbine, wherein the steam turbine comprises a rotor having blades planted on a mono-block rotor shaft in multi-stages from a high steam pressure side to a low steam pressure side and a casing covering said rotor, an inlet temperature of steam to first stage blades is not less than 530° C., the blades of least a final stage have a value of (blade length (inches)×revolution number (rpm)) of not less than 120,000 and is made of martensite steel including 8–13 wt % Cr, and the mono-block rotor shaft has a higher creep rupture strength at the high pressure side than at the low pressure side or a higher toughness at the low pressure side than at the high pressure side, and a combustion gas temperature at a first stage blade of the gas turbine is not less than 1200° C., preferably, not less than 1300° C. and, more preferably, not less than 1400° C.

Further, the present invention resides in a combined cycle power generation system comprising a gas turbine driven by a combustion gas flowing at a high speed, an exhaust heat recovery boiler generating steam with energy of exhaust gas of the gas turbine, a steam turbine driven by the steam from the boiler and a generator driven by the gas turbine and the steam turbine, wherein the gas turbine has blades of at least three stages, a temperature of the combustion gas at a turbine inlet is not less than 1200° C., a temperature of the exhaust gas at a turbine outlet is not less than 530° C., the exhaust heat recovery boiler generates steam of not less than 530° C., the steam turbine is a type in which a high pressure side and low pressure side are integrated into one, made of a Ni—Cr—Mo—V low alloy steel of bainitic structure, and has a rotor shaft having a higher high-temperature strength at the high pressure side than at the low pressure side, and blades having a value of (blade length (inches)×revolution number (rpm)) of not less than 120,000 and made of martensite stainless steel including 8–13 wt % Cr.

The reasons for limiting components of long blade material for high and low pressure sides-integrating steam turbines are discussed hereafter.

The present invention resides in long blades for a high and low pressure sides-integrating steam turbine, each made of a martensite stainless steel comprising, by weight percentage, 0.08–0.18% C, not more than 0.25% Si, not more than 0.9% Mn, 8.0–13.0% Cr, 2–3% Ni, 1.5–3.0% Mo, 0.05–0.35% V, 0.02–0.20% in total of at least one kind of Nb and Ta, and 0.02–0.10% N.

The steam turbine long blade must have a high tensile strength and, at the same time, a high high-cycle fatigue strength because it must bear high centrifugal stresses due to high speed rotation and vibration stresses. Therefore, the metallurgical structure of the blade material must be wholly tempered martensite structure because fatigue strength decreases remarkably when the material has poisonous δ ferrite.

In the steel according to the present invention, the components are adjusted so that a Cr-equivalent calculated by an equation described later is 10 or less and substantially no δ ferrite phase is substantially contained.

The tensile strength of the long blade is not less than 120 $kgf/mm^2$, and preferably, not less than 128.5 $kgf/mm^2$.

In order to obtain steam turbine long blades of homogeneousness and high tensile strength, it is preferable to effect, as a thermally refining heat treatment, such hardening that heats, after melting and forging, to a temperature of 1000–1100° C. (preferably, 1000–1055° C.) preferably keeping the temperature for 0.5–3 hours and then rapidly cools from the temperature to a room temperature (particularly, oil quenching is preferable), next tempering at a temperature of 550–620° C., particularly, twice or more tempering of primary tempering at a temperature of 550–570° C., preferably keeping the temperature for 1–6 hours and then rapidly cooling to a room temperature and secondary tempering at a temperature of 560–590° C., preferably, keeping the temperature for 1–6 hours and then rapidly cooling to a room temperature. It is preferable that the secondary tempering temperature is higher than the primary tempering temperature, particularly, it is preferable to be higher by 10–30° C. and, more preferable, higher by 15–20° C.

The present invention resides in a 3600 rpm steam turbine for 60 hz power generation in which the length of each blade of a low pressure turbine final stage is 838 mm (33 inches) or more, preferably 914 mm (36 inches) or more, more preferably 965 mm (38 inches) or more, and a 3000 rpm steam turbine for 50 Hz power generation in which the length of each blade of a low pressure turbine final stage is 1016 mm (40 inches) or more, preferably 1092 mm (43 inches) or more, more preferably 1168 mm (46 inches) or more, wherein a value of (blade portion length (inches)× revolution (rpm)) is 120,000 or more, preferably, 125,000 or more, and more preferably, 138,000 or more.

Further, in the heat resistant blade material of the present invention, it is preferable to adjust the components so that a Cr equivalent calculated using the contents (wt %) of each element in the following equation becomes 4–10 in order to obtain a high strength, low-temperature toughness and fatigue strength by adjusting metal compositions to become a whole martensite structure;

$$\text{Cr equivalent}=\text{Cr}+6\text{Si}+4\text{Mo}+1.5\text{W}+11\text{V}+5\text{Nb}-40\text{C}-30\text{N}-30\text{B}-2\text{Mn}-4\text{Ni}-2\text{Co}+2.5\text{Ta}$$

C is necessary to be at least 0.08% to obtain a high tensile strength. An excessive amount of C decreases toughness, so that it should be 0.2% or less. In particular, 0.10–0.18% is preferable, and 0.12–0.16% is more preferable.

Si is a deoxidizer, and Mn is a deoxidizing desulfurizing agent. They are added when steel is melted, and even adding a small amount brings about an effect. Si is a δ ferrite producing element. Addition of a large amount of Si becomes a cause to produce poisonous δ ferrite which reduces fatigue strength and toughness, so that it must be 0.25% or less. Further, according to carbon vacuum deoxidizing method and electroslag melting method, it is unnecessary to add Si and it is better not to add Si. In particular, 0.10% or less is preferable and 0.05% or less is more preferable.

An addition of a small amount of Mn increases toughness, however, an addition of a large amount decreases toughness, so that it must be 0.9% or less. In particular, since Mn is effective as a deoxidizer, addition of 0.4% or less is preferable and 0.2% or less is more preferable.

Cr increases corrosion resistance and tensile strength, however, an addition of 13% or more becomes a cause to generate a δ ferrite structure. The corrosion resistance and tensile strength are insufficient when 8% or less is added, so that an amount of Cr is determined to be 8–13%. In particular, from a point of view of strength, 10.5–12.5% is preferable and 11–12% more preferable.

Mo has an effect to raise tensile strength by a solid solution enhancing action and a precipitation enhancing action. Mo, however, is insufficient in an effect to improve the tensile strength, and addition of 3% or more becomes a cause to generate δ ferrite, so that Mo is limited to 1.5–3.0%. In particular, 1.8–2.7% is preferable and 2.0–2.5% is more preferable. W and Co have a similar effect to Mo.

V and Nb have an effect to raise tensile strength by precipitating carbides and at the same time elevate toughness. The effect is insufficient when not more than 0.05% V and not more than 0.02% Nb are added, and the addition of V 0.35% or more, and Nb of 0.2% or more become a cause to generate δ ferrite. In particular, as for V 0.15–0.30% is preferable and 0.25–0.30 is more preferable. As for Nb, 0.04–0.15% is preferable and 0.06–0.12 is more preferable. Ta can be added in the same manner instead of Nb and they can be compoundedly added.

Ni has an effect to improve low temperature toughness and prevent δ ferrite being generated. The effect is insufficient when Ni is 2% or less and saturates by addition of 3% or more. In particular, 2.3–2.9% is preferable and 2.4–2.8% is more preferable.

N has an effect to improve tensile strength and prevent δ ferrite being generated, however, the effect is insufficient with 0.02% or less, and an addition of more than 0.1% decreases toughness. In particular, excellent characteristics can be obtained in a range of 0.04–0.08%, and more in a range of 0.06–0.08%.

A decrease in Si, P and S brings about an effect to improve a low temperature toughness without lowering tensile strength, so that it is desirable to reduce them. From a point of view of improvement of the low temperature toughness, Si of 0.1% or less, P of 0.015% or less and S of 0.015 or less are preferable, in particular, Si of 0.05% or less, P of 0.010% or less and S of 0.010% or less are desirable. A decrease of Sb, Sn and As also have an effect to raise low temperature toughness, and it is desirable to significantly reduce them. However, from a point of view of steel production technology level at present, they are limited to Sb of 0.0015% or less, Sn of 0.01 or less and As of 0.02% ore less. In particular, Sb of 0.0010% or less, Sn of 0.005% or less and As of 0.01% or less are preferable.

Further, in the present invention, a ratio of Mn/Ni is preferable to be 0.11 or less.

Heat treatment of the material of the present invention is preferably as described hereafter. First of all, the material is uniformly heated to a temperature sufficient to transform it into perfect austenite, that is, to 1000° C. at minimum and 1100° C. at maximum, rapidly cooled (preferably, oil cooling), and then, heated and kept at a temperature of 550–570° C. and cooled (primary tempering). Next, it is heated and kept at a temperature of 560–680° C. to effect secondary tempering to make it into a wholly tempered martensite structure.

Explanation of compositions and reasons for limiting heat treatment conditions of a low alloy steel forming a rotor of a high and low pressure side-integrating steam turbine of the present invention are described hereafter.

C is an element necessary to raise hardenability and secure strength. A C content of 0.15% or less can not provide a sufficient hardenability, soft ferrite structure is formed in the center of a rotor, and sufficient tensile strength and yield strength can not be obtained. C of 0.4% or more decreases toughness, so that a range of C is preferable to be 0.15–0.4%, and a range of 0.20–0.28% is more preferable.

Si and Mn were added as deoxidizer. However, according to a vacuum C deoxidizing method and an electroslag remelting method, a sound rotor can be produced through melting without particularly adding such elements. It is necessary for Si and Mn to be smaller in view of brittleness due to use for a long time. Si and Mn are preferable to be 0.1% or less and 0.5% or less, respectively. In particular, Si of 0.05% or less and Mn of 0.05–0.25% are preferable and Si of 0.01% or less and Mn of 0.20% or less are more preferable.

On the other hand, since an addition of Mn of a minimum amount acts to fix poisonous S worsening hot workability as sulphide MnS, the addition of Mn of a minimum amount has an effect of reducing the above-mentioned harm of S, so that Mn is preferable to contain 0.01% or more in manufacturing of a large sized forging product such as a rotor shaft of a steam turbine. However, since an addition of Mn decreases toughness and high temperature strength, if it is possible to make S less in manufacturing of steel, Mn is better to be zero if super-cleaning for reducing amount of S and P is possible, and 0.01–0.2% is preferable.

Ni is an essential element to improve hardenability and toughness. 1.5% or more is preferable to improve toughness and 2.7% or less is preferable to prevent decrease in creep rupture strength. Particularly, a range of 1.6–2.0% is preferable and a range of 1.7–1.9 is more preferable. Further, an addition of Ni can obtain characteristics of a high high-temperature strength and toughness by making an amount of Ni larger than an amount of Cr by at most 0.20%, or smaller than an amount of Cr by 30% or less.

An addition of Cr of 1.5% or more improves hardenability and provides an effect to improve toughness and strength, further, corrosion resistance in steam is improved thereby. An addition of Cr of 1.5% or less is insufficient to obtain such an effect. Addition of Cr of 2.5% or less is preferable to prevent decrease in creep rupture strength. Particularly, a range of 1.9–2.1% is more preferable therefor.

Mo of 0.8% or more precipitates very fine carbides in crystal grains during tempering treatment, and brings about an effect of raising high-temperature strength and preventing brittleness due to tempering. 2.5% or less is preferable for preventing toughness being decreased. In particular, 1.0–1.5% is preferable from a point of view of strength and toughness and 1.1–1.3% more preferable.

V of 0.15% or more precipitates very fine carbides in crystal grains during tempering treatment, and brings about an effect of raising high-temperature strength and preventing brittleness due to the tempering. However, 0.35% or less is sufficient to obtain such an effect. In particular, a range of 0.20–0.30% is preferable and the range of more than 0.25% and not more than 0.30% is more preferable.

When a low alloy of the above compositions is formed by melting, toughness is improved by adding any one element of rare-earth elements, Ca, Zr and Al. Such an effect is insufficient by adding a rare-earth element of less than 0.05%, and the effect saturates by adding more than 0.4%. Ca has an effect of raising toughness by adding a small amount, however, the effect is insufficient by adding less than 0.0005% and saturates by adding more than 0.01%. Zr of less than 0.01% does not sufficiently bring about an effect of raising toughness, and the effect saturates by adding Zr of more than 0.2%. Al of 0.001–0.02% brings an effect of raising toughness and creep rupture strength.

Further, oxygens are concerned with high-temperature strength. In the steel according to the present invention, a higher creep rupture strength can be obtained by controlling $O_2$ to be in the range of 5–25 ppm.

It is preferable to add 0.005–0.15% of at least one of Nb and Ta. In a large-sized construction such as a steam turbine rotor shaft, an addition of 0.005–0.15% is preferable for suppressing crystallization of those huge carbides and raising strength and toughness. Particularly, 0.01–0.05% is preferable.

An addition of W of 0.1% or more is preferable for raising strength, however, an addition of more than 1.0% brings about a problem of precipitation in a large sized lump and lowers strength, so that 0.1–1.0% is preferable and 0.1–0.5% is more preferable.

A ratio of Mn/Ni and a ratio of (Si+Mn)/Ni are preferable to be 0.13 and 0.18 or less, respectively. Thereby, brittleness due to heating in a low alloy steel Ni—Cr—Mo—V having bainitic structure can be remarkably prevented and the alloy steel can be used for a high and low pressure side-integrated mono-block type rotor shaft. Further, a high 538° C. $10^5$ h creep rupture strength of 12 kg/mm$^2$ can be obtained by making a ratio of Ni/Mo at least 1.25, a ratio of Cr/Mo at least 1.1, or a ratio of Cr/Mo at least 1.45 and a ratio of Cr/Mo more than a value calculated by (−1.11×Ni/Mo+2.78) and by effecting heat treatment of the whole alloy under the same conditions.

Further, an alloy structure having a higher strength at a high pressure side and a high toughness at a low pressure side can be obtained by utilizing an amount of Ni in a specific range relative to an amount of Cr.

In a high and low pressure side-integrating steam turbine rotor shaft, it is preferable that a 538° C. $10^5$ h flatness and notch creep rupture strength is 13 kg/mm$^2$ or more at a high pressure side thereof, tensile strength is 84 kg/mm$^2$ or more, and fracture appearance transition temperature (FATT) is 35° C. or less. In order to obtain such an excellent mechanical property, it is preferable to effect the following inclined refining heat treatment. Before effecting this refining heat treatment, it is preferable to perform perlite treatment of keeping at 650–710° C. for 70 hours or more to make fine metallurgical structure.

A high pressure side or high and middle pressure side, of a rotor shaft: to obtain a high high-temperature strength.

Hardening: heating and keeping at 930–970° C. and then cooling.

Tempering: heating and keeping at 570–670° C. and then gradually cooling.

(Twice tempering is preferable, and it is preferable to effect, at least once, heating and keeping at 650–670° C.)

A low pressure side or middle and low pressure side, of the rotor shaft: to obtain a high tensile strength and low-temperature toughness.

Hardening: heating and keeping at 880–910° C. and then cooling.

Tempering: heating and keeping at 570–640° C. and then gradually cooling.

(Twice tempering is preferable, and it is preferable to effect, at least once, heating and keeping at 615–635° C.).

That is, in the present invention, such an inclined heat treatment is preferable that the high pressure side or high and middle pressure side is hardened at a higher hardening temperature than the low pressure side, whereby a high-temperature strength at the high pressure side or high and middle pressure side is made higher than at the lower pressure side so as to obtain creep rupture time of 180 hours or more at 550° C. and 30 kg/mm$^2$, and transition temperature at the lower pressure side is made lower by 10° C. or more than at the high pressure side or high and middle pressure side. A tempering temperature also is preferable to be higher at the high pressure side or high and middle pressure side than at the low pressure side. In any of hardening and tempering, it is preferable to take deviation heating and same cooling that heating temperature is changed and cooling is effected with the same means. Further, the inclined heat treatment also can be performed between the high pressure side and the middle and low pressure side.

In this manner, steel having both a high creep rupture strength and a high impact value can be obtained. In the high and low pressure sides integrated rotor shaft, blades can be planted on the rotor shaft, which blades each have the length of 40 inches or more, preferably, 43 inches or more for 50 Hz power generation, and 33 inches or more, preferably, 35 inches or more for 60 Hz power generation.

By using such a noble material for the rotor shaft, the above-mentioned long blades can be planted as final stage blades, and a ratio L/D between a length L between bearings for the rotor shaft and a blade diameter D can be made compact, that is, 1.4–2.3, preferably, 1.6–2.0. Further, a ratio (d/l) between the maximum diameter (d) of the rotor shaft and the length (l) of the final stage long blade can be made 1.5–2.0, whereby an amount of steam can be increased to the maximum in a relation to the rotor shaft characteristics, and a power generation system of large size and large capacity is possible. Particularly, this ratio is preferable to be 1.6–1.8. The ratio of 1.5 or more can be obtained from a relation of the number of blades, and the more the number is the better the efficiency is. However, 2.0 or less is preferable from the point of view of centrifugal force.

A steam turbine using the high and low pressure sides-integrated mono-block rotor shaft of the present invention can output from 100,000 kW to 300,000 kW with a compact type. Expressing a distance between the bearings of the rotor shaft as a distance per power generation unit, the distance between the bearings can be made very short, that is, it is 0.8 m or less per 10,000 kW, preferably, 0.25–0.6 m per 10,000 kW.

By using the above-mentioned Ni—Cr—Mo—V low alloy steel for the high and low pressure sides-integrated mono-block rotor shaft, blades of the length of 30 inches or more, particularly, 33.5 inches or more can be provided for at least a final stage, an output per unit machine and the efficiency of the machine can be increase and it can be made compact.

Moving blades (simply, referred to as blades) and stationary vanes (or nozzles) in the steam turbine according to the present invention are as discussed hereafter.

The above-mentioned high pressure side blades are preferable to be martensite steel comprising, by weight, 0.2–0.3% C, not more than 0.5% Si, not more than 1% Mn, 10–13% Cr, not more than 0.5% Ni, 0.5–1.5% Mo, 0.5–1.5% W and 0.15–0.35% V, for the first to third stages, and the above-mentioned less than 26 inches low pressure side blades other than the above blades are preferably to be martensite steel comprising, by weight, 0.05–0.15% C, not more than 0.5% Si, not more than 1%, preferably, 0.2–1.0% Mn, 10–13% Cr, not more than 0.5% Ni and not more than 0.5% Mo.

It is preferable that a leading edge portion of a tip portion of the final stage blade is provided with an erosion prevention layer. As a concrete blade length, the following can be used; 33.5", 40", 46.5", etc.

Stationary vanes according to the present invention are preferable to be a tempered whole martensite steel comprising, by weight, 0.05–0.15% C, not more than 0.5% Si, 0.2–1% Mn, 10–13% Cr, not more than 0.5% Ni, not more than 0.5% Mo.

A casing according to the present invention is preferable to be a Cr—Mo—V cast steel having bainitic structure, and comprising, by weight, 0.10–0.20% C, not more than 0.75% Si, not more than 1% Mn, 1–2% Cr, 0.5–1.5% Mo, 0.05–0.2% V and not more than 0.05% Ti.

For the rotor shaft of Ni—Cr—Mo—V steel comprising the above-mentioned compositions, an alloy having mainly bainitic structure is produced as follows and used. That is, its steel lump is melted by electroslag remelting or melting in the atmosphere in an arc furnace, then a non-oxidizing gas (particularly, Ar gas) is blown from a ladle lower portion, then a steel lump which is vacuum-carbon-deoxidized is produced, the steel lump is hot-forged, subjected to hardening which heats the lump to an austinizing temperature and cools at a proper cooling speed, and then tempered, whereby preferably, the alloy having mainly bainitic structure is formed.

A gas turbine relating to the present invention has the construction discussed hereafter:

At least one kind, in the final stage, of a disc, a distant piece, turbine spacers, turbine stacking bolts, compressor stacking bolts and compressor discs can be constructed with a heat resistant steel having wholly tempered martensite structure and comprising, by weight, 0.05–0.2% C, not more than 0.5% Si, not more than 1% Mn, 8–13% Cr, not more than 3% Ni, 1.5–3% Mo, 0.05–0.3% V, 0.02–0.2% Nb and 0.02–0.1% N. By constructing all those parts with this heat resistant steel, a higher gas temperature can be employed, whereby the thermal efficiency is improved. Particularly, it is preferable that at least one kind of all those parts is made of heat resistant steel having wholly tempered martensite structure and comprising, by weight, 0.05–0.2% C, not more than 0.5% Si, not more than 0.6% Mn, 8–13% Cr, 2–3% Ni, 1.5–3% Mo, 0.05–0.3% V, 0.02–0.2% Nb and 0.02–0.1% N, and a ratio of Mn/Ni of not more than 0.13, preferably, 0.04–0.10.

Further, as a material used for those parts, a martensite steel is used which has a 450° C. $10^5$ h creep rupture strength of 40 kg/mm$^2$ or more and 20° C. V-notch Charpy impact value of 5 kg-m/cm$^2$ or more, and a steel of particularly preferable compositions can have a 450° C., $10^5$ h creep rupture strength of 50 kg/mm$^2$ or more and 20 ° C. V-notch Charpy impact value after heating at 500° C. and $10^5$ h of 5 kg-m/cm$^2$ or more.

Those material can further include at least one kind of the following elements: not more than 1% W, not more than 0.5% Co, not more than 0.5% Cu. not more than 0.01% B, not more than 0.5% Ti, not more than 0.3% Al, not more than 0.1% Zr, not more than 0.1% Hf, not more than 0.01% Ca, not more than 0.01% Mg, not more than 0.01% Y and a rare-earth element of not more than 0.01%.

At least a final stage or all the stages of the compressor discs can be made of the above-mentioned heat resistant steel. However, since a gas temperature from the first stage to a central portion is low, other low alloy steel can be used, and the above-mentioned heat resistant steel can be used for discs from the central portion to the final stage. Compressor discs at an upstream side from a first stage to the central portion with respect to air flow can use a Ni—Cr—Mo—V steel comprising, by weight, 0.15–0.30% C, not more than 0.5% Si, not more than 0.6% Mn, 1–2% Cr, 2.0–4.0% Ni, 0.5–1% Mo and 0.05–0.2% V, and having a room temperature tensile strength of 80 kg/mm or more and room temperature V-notch Charpy impact value of 20 kg-m/cm$^2$ or more, and compressor discs from the central portion to the final stage except the final stage can use a Cr—Mo—V steel comprising, by weight, 0.2–0.4% C, 0.1–0.5% Si, 0.5–1.5% Mn, 0.5–1.5% Cr, not more than 0.5% Ni, 1.0–2.0% Mo, 0.1–0.3% V, and having a room temperature tensile strength of 80 kg/mm$^2$ or more and elongation percentage of 18% or more and drawing rate of 50% or more.

The compressor stub shaft and turbine stub shaft can use the above-mentioned Cr—Mo—V steel.

The rotor for a compressor according to the present invention can take any of a disc-shaped type, a split type formed by integrating blades of a plurality of stages, and a one piece type of all the blades. The disc-shaped type and the split type each have a plurality of through holes for inserting stacking bolts, provided on the periphery.

As an example of the rotor material for a compressor, in a case of a 17 stage compressor, a material for the first stage to the 12th stage is the above-mentioned Ni—Cr—Mo—V steel, a material for the 13th stage to the 16th stage is a Cr—Mo—V steel and a material for the 17th stage is the above-mentioned martensite steel.

Compressor blades are preferable to be made of a martensite steel comprising, by weight, 0.07–0.15% C, not more than 0.15% Si, not more than 1% Mn and 10–13% Cr, or further including, in addition to the above compositions, not more than 0.5% Mo and not more than 0.5% Ni.

For a first stage portion of a shroud, slidably contacting with turbine blades and formed in a ring-shape, a Ni-base cast alloy is used, which comprises 0.05–0.2% C, not more than 2% Si, not more than 2% Mn, 17–27% Cr, not more than 5% Co, 5–15% Mo, 10–30% Fe, not more than 5% W and not more than 0.02% B. and the other portion of the shroud is preferable to be made of a Fe-base cast alloy including, by weight, 0.3–0.6% C, not more than 2% Si, not more than 2% Mn, 20–27% Cr. not more than 20–30% Ni, 0.1–0.5% Nb and 0.1–0.5% Ti. Those alloys are formed in ring-shape by incorporating a plurality of blocks to form the shroud.

Diaphragms for fixing turbine nozzles are formed, of which first stage nozzle portions are made of, preferably, an austenitic steel comprising, by weight, not more than 0.05% C, not more than 1% Si, not more than 2% Mn, 16–22% Cr and 8–15% Ni, and the other portion is made of, preferably, a high-C high-Ni steel casting.

For the turbine blades, a Ni-base cast alloy is used, which alloy comprises, by weight, 0.07–0.25% C, not more than 1% Si, not more than 1% Mn, 12–20% Cr. 5–15% Co, 1.0–5.0% Mo, 1.0–5.0% W, 0.005–0.03% B, 2.0–7.0% Ti, 3.0–7.0% Al and at least one kind of, not more than 1.5% Nb, 0.01–0.5% Zr, 0.01–0.5% Hf and 0.01–0.5% V, and having γ' phase and γ" phase precipitated in a matrix of austenitic phase.

Further, for the turbine blades, it is preferable to apply thereto diffusion coating of Al, Cr or (Al+Cr) to prevent corrosion due to high temperature combustion gas, and provide thereon a heat shield coating layer of stabilized $ZrO_2$ ceramics. Thickness of the coating layer is 30–150 μm, and it is preferable to provide it on a portion of each blade contacting with the gas.

For the gas turbine nozzles, a Ni-base super alloy and Co-base alloy are used. In a case where combustion gas temperature is 1260° C. or lower, for the first stage nozzles, it is preferable to use Ni-base alloy described later, and for nozzles other than the first stage nozzles, it is preferable to use a Co-base cast alloy comprising, by weight, 0.20–0.60% C, not more than 2% Si, not more than 2% Mn, 25–35% Cr, 5–15% Ni, 3–10% W, 0.003–0.03% B and the balance of substantial Co, or further including thereto at least one kind of 0.1–0.3% Ti, 0.1–0.5% Nb and 0.1–0.3% Zr, and having eutectic carbides and secondary carbides in austenitic phase base. Those alloys are subjected to aging treatment after solid solution treatment, thereby forming the above-mentioned precipitation and strengthening.

For the gas turbine first stage nozzles, it is preferable to use a Ni-base cast alloy comprising, by weight, 0.05–0.20% C, 15–25% Co, 15–25% Cr, 1.0–3.0% Al, 1.0–3.0% Ti, 1.0–3.0% Nb, 5–10% W and not less than 42% Ni. Particularly, an amount of (Al+Ti) and amount of W are preferable to be within a range enclosed by lines connecting the points of A(2.5%, 10%), B(5%, 10%), C(5%, 5%), D(3.5%, 5%) and E(2.5%, 7.5%). In particular, it is preferable that C is 0.08–0.16%, Co is 20–25%, Al+Ti is 3.0–5.0%, Ti/Al is 0.7–1.5%, Nb is 0.6–1.0%, Ta is 0.9–1.3%, Zr is not more than 0.05%, B is 0.001–0.03%, W is 6–8%, Re is not more than 2%, at least one kind of Y and Sc is not more than 0.5%. Further, Si and Mn each are preferable to be not more than 0.5%, more preferably, 0.01–0.1%.

This Ni-base cast alloy has a rupture strength of 300 hours or more at 900° C. 14 kg/mm$^2$, particularly, 1000–5000 hours.

In the gas turbine according to the present invention, in a case where a combustion gas temperature is not more than 1300° C., it is preferable that a first stage at the gas inlet side or all the stages is made of a Ni-base cast alloy comprising, by weight, 0.05–0.20% C, 20–25% Co, 15–25% Cr, 1.0–3.0% Al, 1.0–3.0% Ti, 1.0–3.0% Nb, 5–10% W and not less than 42% Ni. The first stage is made of this Ni-base cast alloy and the second and other stages except the first stage is made of a Co-base cast alloy comprising, by weight, 0.2–0.6% C, not more than 2% Si, not more than 2% Mn, 25–35% Cr, 5–15% Ni, 3–10% W, 0.003–0.03% B and not less than 50% Co. Further, in a case where a combustion gas temperature is more than 1300° C., the above-mentioned Ni-base alloy or Co-base alloy is preferable for the second and third stages except the first stage. For the first stage, a single crystal alloy casting of Ni-base or Co-base alloy is preferable. With the above nozzle construction, an inspection period of a regular inspection that is conducted once a year can be extended to once per 2 years, at least. A Ni-base alloy preferably includes at least one kind of, not more than 2% Mo, not more than 0.3% Zr, not more than 0.5% Hf, not more than 0.5% Re and not more than 0.2% Y.

A plurality of combustors are arranged around a turbine, each combustor has a double construction of an outer cylinder and inner cylinder. The inner cylinder is made of a Ni-base alloy comprising, by weight, 0.05– 0.2% C, not more than 2% Si, not more than 2% Mn, 20–25% Cr, 0.5–5% Co, 5–15% Mo, 10–30% Fe, not more than 5% W and not more than 0.02% B, or a heat resistant steel having the above compositions in which 25–40% Ni is included instead of Fe, the inner cylinder is formed by welding a plastically reduced material of 2–5 mm thickness, casting into one piece, or centrifugal casting, and provided with crescent rubbers for supplying air or cooling fins formed on the periphery. As the material for the inner cylinder, a material subjected to solid solution and having whole austenitic structure is used. The cooling fins each have a proper height and intervals integrally formed on the outer periphery, whereby the inner cylinder with cooling fins can be used without providing the rubbers. Preferably, the cooling fins are spirally formed. In a case where the inner cylinder is a cast tube, the thickness is preferable to be 2–5 mm.

According to the present invention, a high and low pressure side-integrating steam turbine having long blades of 33 inches or more and being usable at a higher temperature can be produced. The turbine can increase an output per one machine, with a compact size. As a result, thermal efficiency can be improved and power generation cost can be reduced.

DESCRIPTION OF EMBODIMENTS OF THE INVENTION

EMBODIMENT 1

Figure 1:
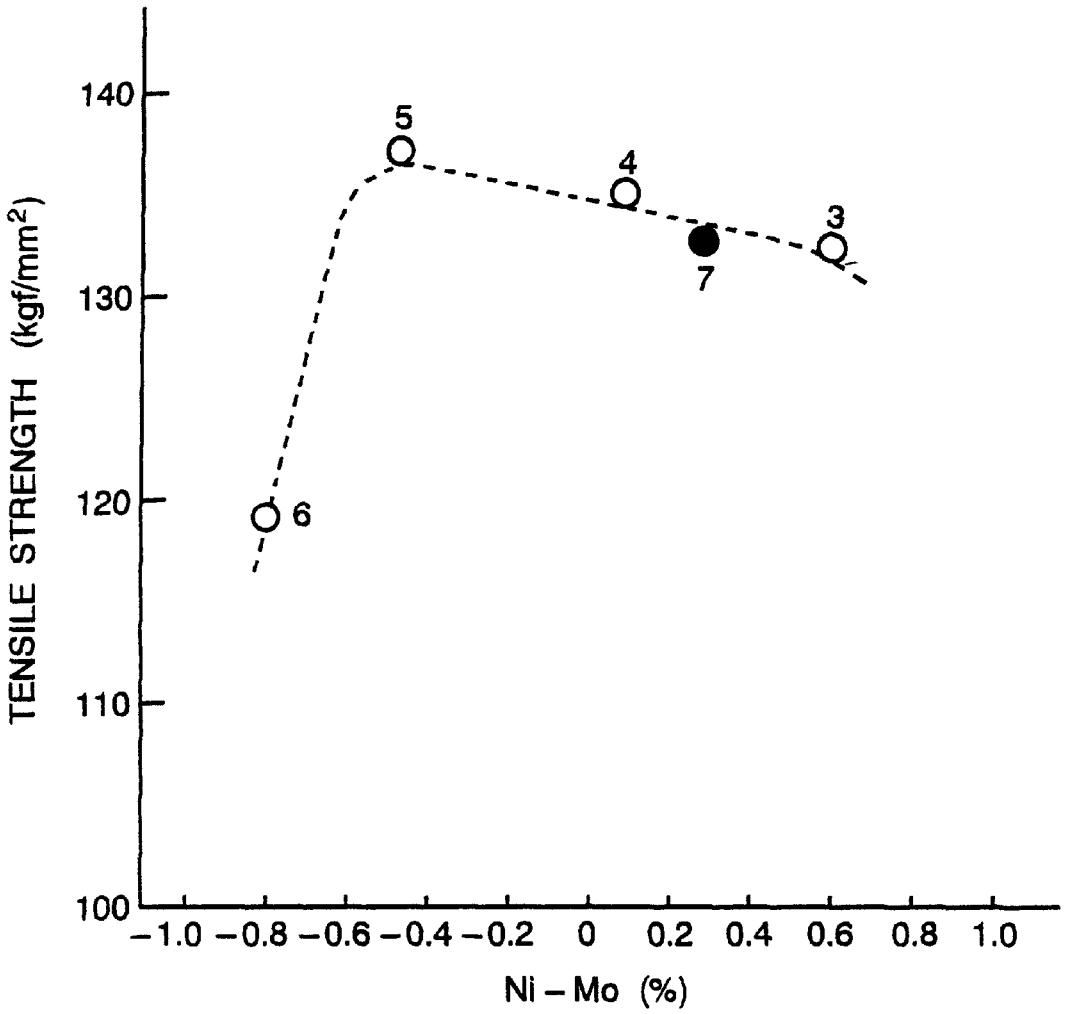
FIG. 1 is a diagram showing a relation between tensile strength and (Ni—Mo)

Table 1 shows chemical compositions (weight %) of 12% Cr steel relating to a long blade material for a high and low pressure sides-integrating steam turbine. Samples Nos 1 are experimental raw material which is formed by melting 150 kg by vacuum high frequency melting, heating to 1150° C. and then forging. Sample No. 1 is heated at 1000° C. for 1 hours, then cooled to a room temperature by hardening or quenching, and then heated to 570° C., kept at the temperature for 1 hour then air-cooled to the room temperature. Sample No.2 is heated at 1050° C. for 1 hour, then cooled to a room temperature by oil-quenching, and then heated to 570° C., kept at the temperature for 2 hours then air-cooled to the room temperature. Samples Nos. 3 to 7 each are heated at 1050° C. for 1 hour, then cooled to a room temperature by oil-quenching, next heated to 560° C., kept at the temperature for 2 hour then air-cooled to the room temperature (primary tempering), further heated to 580° C., kept at the temperature for 1 hour and then cooled in a furnace to a room temperature (secondary tempering).

TABLE 1

| No. | C | Si | Mn | Cr | Ni | Mo | W | V | Nb | N | Ni − Mo | Nb/C | C + Nb | Nb/N |
|---|---|---|---|---|---|---|---|---|---|---|---|---|---|---|
| 1 | 0.12 | 0.15 | 0.75 | 11.5 | 2.60 | 1.70 | — | 0.36 | — | 0.03 | 0.90 | — | — | — |
| 2 | 0.28 | 0.28 | 0.71 | 11.6 | 0.73 | 1.10 | 1.12 | 0.21 | — | 0.04 | — | — | — | |
| 3 | 0.14 | 0.04 | 0.16 | 11.4 | 2.70 | 2.10 | — | 0.26 | 0.08 | 0.06 | 0.60 | 0.57 | 0.22 | 1.33 |
| 4 | 0.13 | 0.04 | 0.15 | 11.5 | 2.50 | 2.40 | — | 0.28 | 0.10 | 0.05 | 0.10 | 0.77 | 0.23 | 2.0 |
| 5 | 0.13 | 0.06 | 0.15 | 11.4 | 2.65 | 3.10 | — | 0.25 | 0.11 | 0.06 | −0.45 | 0.85 | 0.22 | 1.83 |
| 6 | 0.14 | 0.04 | 0.17 | 11.4 | 2.61 | 3.40 | — | 0.26 | 0.10 | 0.06 | −0.79 | 0.71 | 0.24 | 1.67 |
| 7 | 0.14 | 0.04 | 0.15 | 11.5 | 2.60 | 2.30 | — | 0.27 | 0.10 | 0.07 | 0.30 | 0.71 | 0.24 | 1.43 |

In the table 1, Nos. 3, 4 and 7 are materials of the present invention, Nos. 5 and 6 are comparison materials, and Nos. 1 and 2 are long blade materials used at present.

Table 2 shows mechanical properties of these samples at room temperature. It was confirmed that the invention materials (Nos. 3, 4 and 7)sufficiently satisfy a tensile strength (120 kgf/mm$^2$ or more, or 128.5 kgf/mm or more) and a low temperature toughness (20° C. V-notch Charpy impact value of 4 kgf-m/cm$^2$ or more), required as a steam turbine long blade material.

On the contrary, when the comparison materials Nos. 1, 5 and 6 are used as steam turbine long blades, any one or both of a tensile strength and an impact value are low. The comparison material No. 2 is low in tensile strength and toughness. No. 5 is a little low in impact value, that is, 3.8 kgf-m/cm$^2$, which value is a little insufficient for 43" long blades because 4 kgf-m/cm$^2$ or more is required for the long blades.

TABLE 2

| Sample No. | Tensile stength (kgf/mm$^2$) | Elongation (%) | Drawing (%) | Impact value (kgf-m/cm$^2$) |
|---|---|---|---|---|
| 1 | 114.4 | 19.0 | 60.1 | 8.0 |
| 2 | 114.6 | 18.6 | 59.7 | 1.2 |
| 3 | 132.5 | 21.0 | 67.1 | 5.2 |
| 4 | 134.9 | 20.8 | 66.8 | 4.8 |
| 5 | 137.0 | 18.5 | 59.8 | 3.8 |
| 6 | 118.7 | 21.1 | 67.3 | 5.2 |
| 7 | 133.5 | 20.1 | 60.4 | 5.1 |

FIG. 1 is a graph showing a relation between an amount of (Ni—Mo) and tensile strength. In this embodiment, Ni and Mo are contained so as to be equivalent contents, whereby both of strength and toughness at low temperature are raised. The strength tends to decrease according to an increase in difference (Ni—Mo) in the content between them. The strength rapidly decreases when an amount of Ni becomes less by 0.6% or more than an amount of Mo, and the strength also rapidly decreases when the amount of Ni becomes more by 1.0% or more than an amount of Mo. Therefore, the strength is highest when an amount (Ni—Mo) is −0.6–+1.0%.

Figure 2:
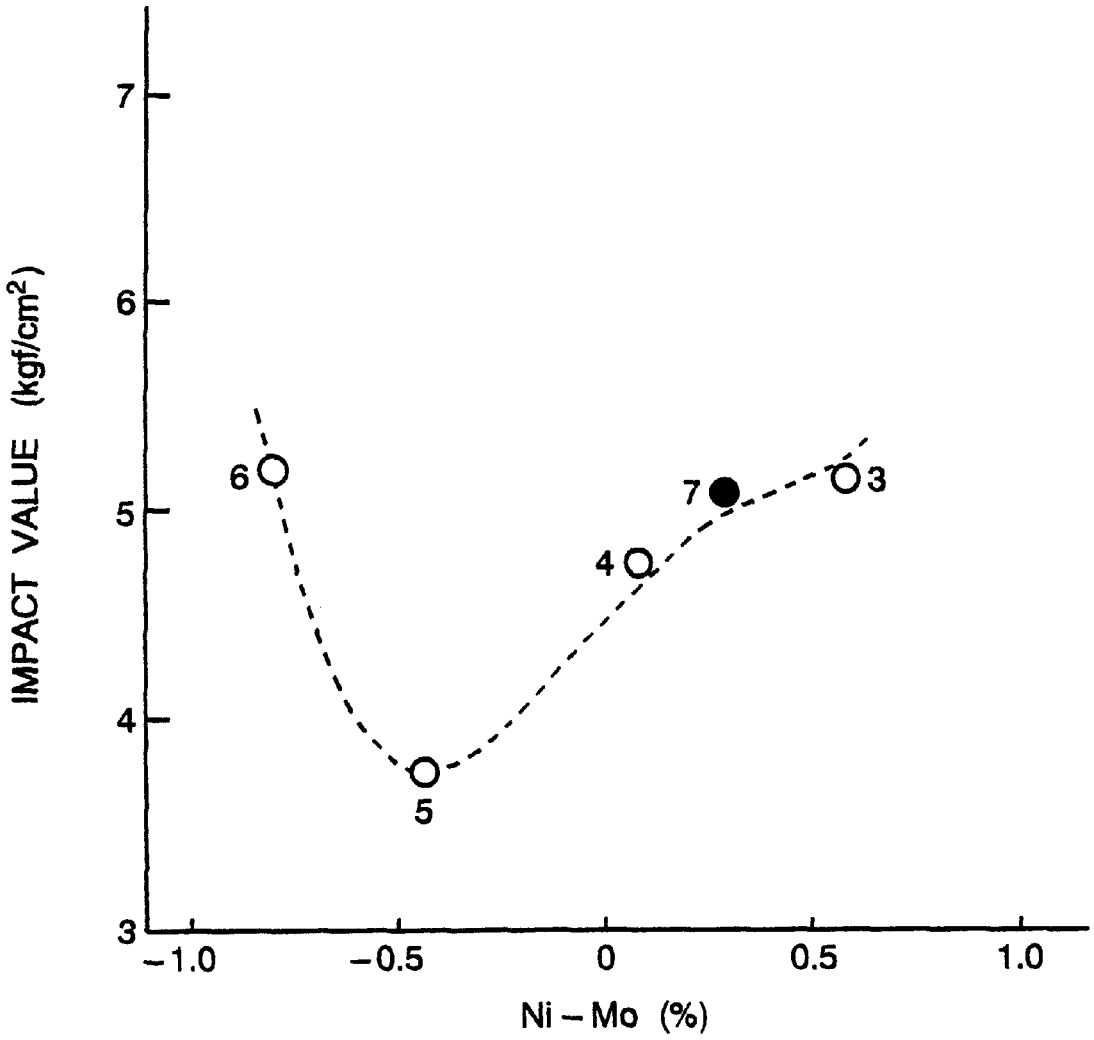
FIG. 2 is a diagram showing a relation between impact values and (Ni—Mo)

FIG. 2 is a graph showing a relation between an amount (Ni—Mo) and impact value. As shown in FIG. 2, an impact value decreases around an amount of (Ni—Mo) of about −0.5%, however, the impact value is high where the amount is smaller or larger than about −0.5%.

Figure 3:
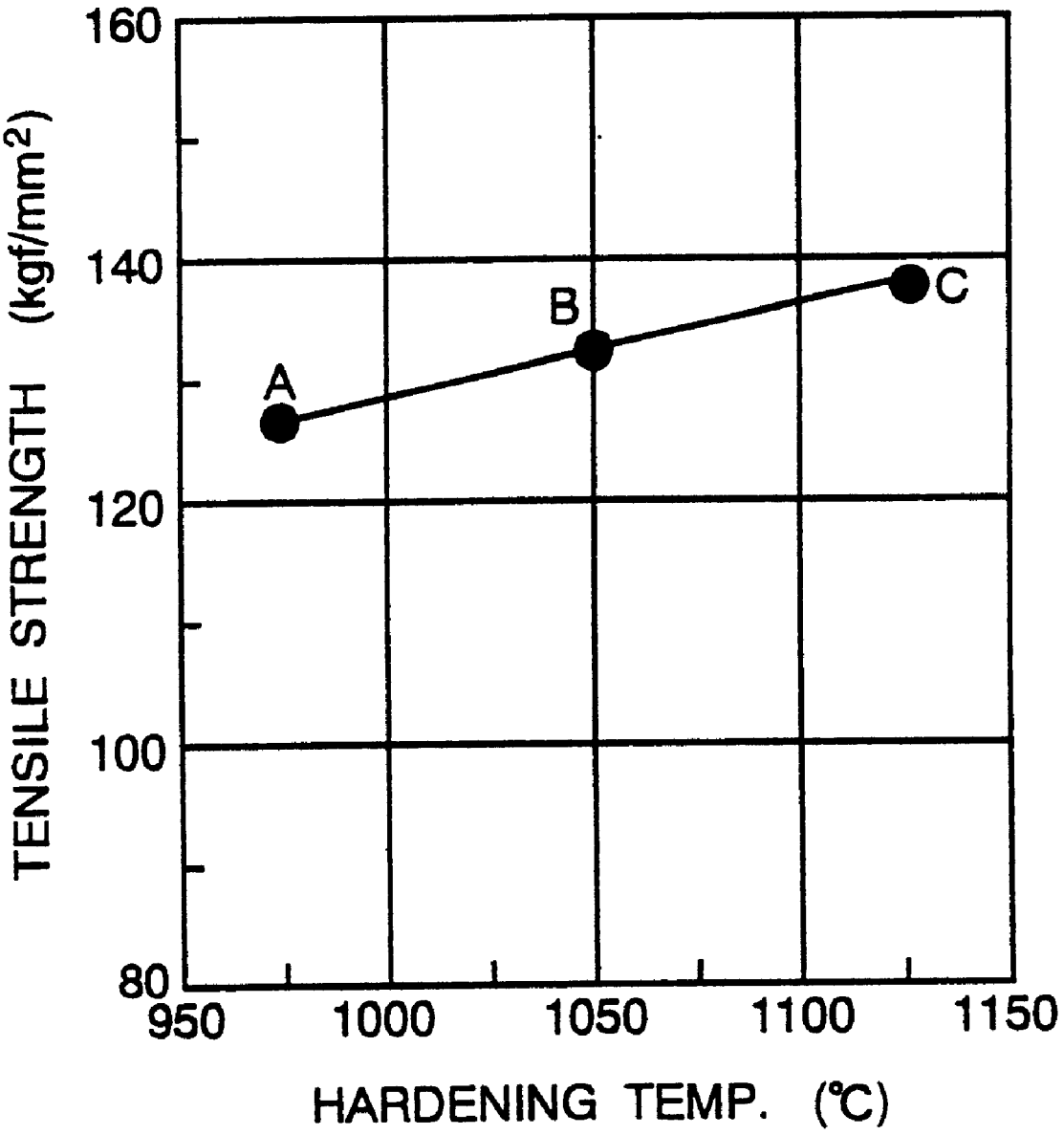
FIG. 3 is a diagram showing a relation between tensile strength and hardening temperature.
Figure 4:
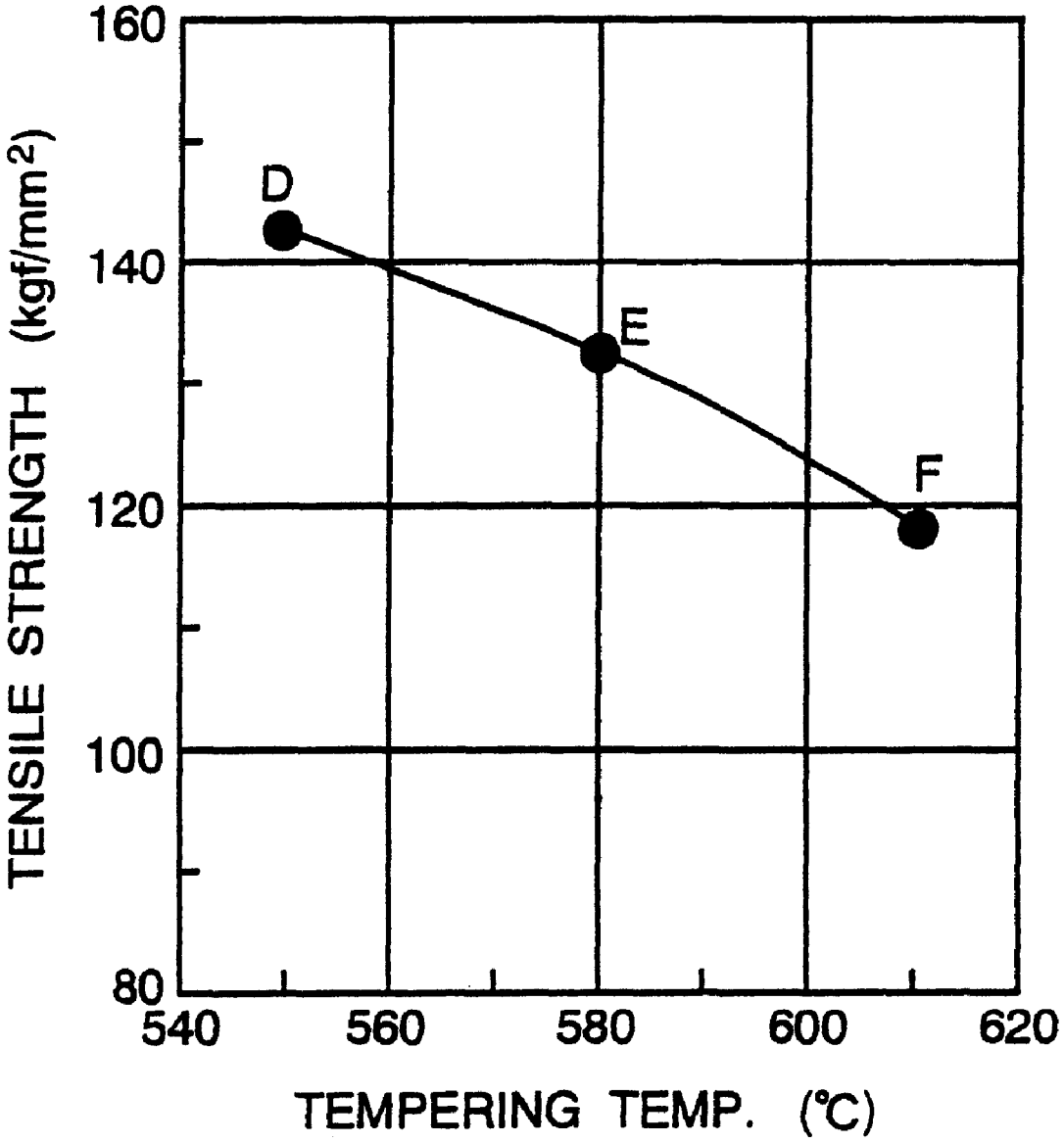
FIG. 4 is a diagram showing a relation between tensile strength and tempering temperature.
Figure 5:
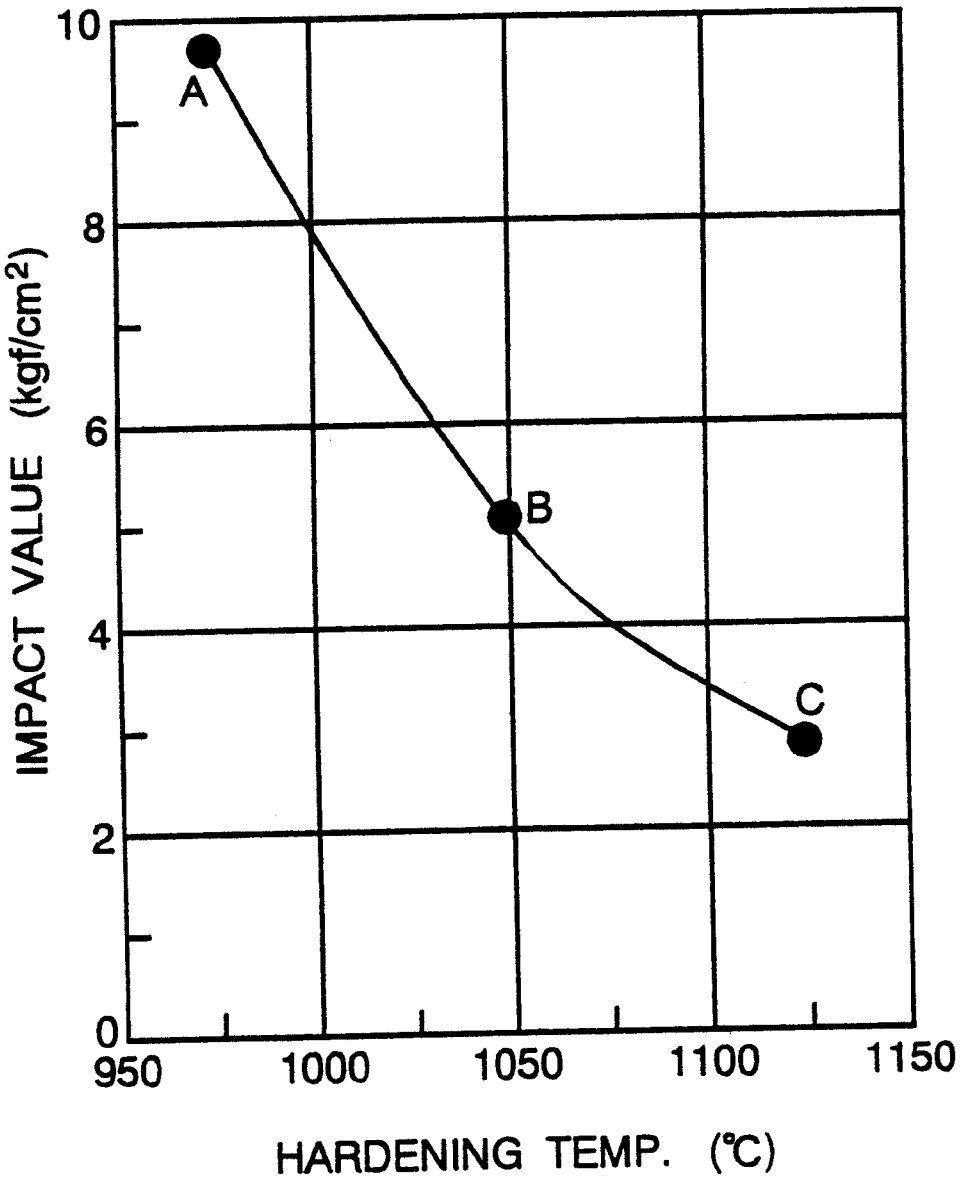
FIG. 5 is a diagram showing a relation between impact values and hardening temperature.
Figure 6:
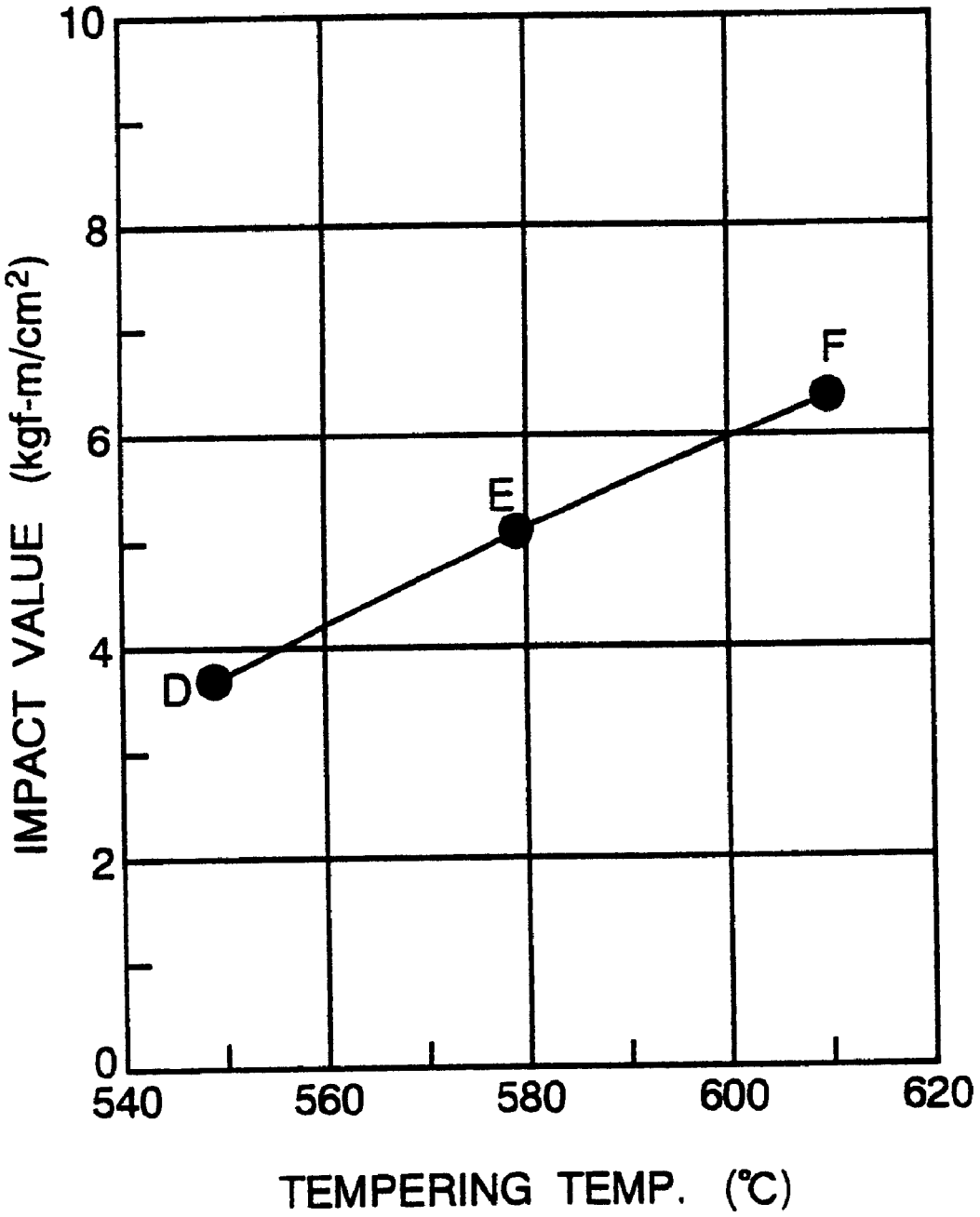
FIG. 6 is a diagram showing a relation between impact values and tempering temperature.

FIGS. 3 to 6 are graphs showing an influence of heat treatment (hardening temperature and secondary tempering temperature) on a tensile strength and toughness of sample No. 3. After hardening was effected at a temperature of 975–1125° C. and 1-hour tempering was effected at a temperature of 550–560° C., secondary tempering was effected at a temperature of 560–590° C. As showing in these figures, it was confirmed that the property (tensile strength≧128.5 kgf/mm$^2$, 20° C. notch Charpy impact value≧4 kgf-m/cm$^2$) required for the long blades is satisfied. Further, The secondary tempering temperature shown in FIGS. 4 and 6 is 575° C., and the hardening temperature shown in FIGS. 3 and 5 is 1050° C.

In the 12% Cr steel according to the present invention, particularly, it is preferable that an amount of (C+Nb) is 0.18–0.35%, a ratio of Nb/C is 0.45–1.00 and a ratio of Nb/N is 0.8–3.0.

EMBODIMENT 2

Table 3 shows chemical compositions (by weight %) of 12% Cr steel relating to a steam turbine long blade in the same manner as the embodiment 1. Each sample is melted by vacuum arc melting and forged at about 1150° C.

Table 4 shows heat treatment, mechanical properties at that temperature and metallurgical structure, of each sample. All the samples have wholly tempered martensitic structure. Average crystal grain size of each sample is 5.5–6.0 by grain size number (GSNo.)

TABLE 3

(Wt. %)

| Steel | C | Si | Mn | P | S | Cu | Ni | Cr | Mo | V | Nb | N | H | Al | Sn | As | Sb |
|---|---|---|---|---|---|---|---|---|---|---|---|---|---|---|---|---|---|
| 8 | 0.13 | 0.02 | 0.18 | 0.005 | 0.002 | <0.01 | 2.63 | 11.33 | 1.93 | 0.26 | 0.084 | 0.073 | 0.0001 | 0.001 | <0.001 | 0.0019 | <0.001 |
| 9 | 0.14 | 0.04 | 0.16 | 0.005 | 0.002 | <0.01 | 2.63 | 11.36 | 2.21 | 0.27 | 0.083 | 0.072 | 0.0002 | 0.002 | <0.001 | 0.0019 | <0.001 |
| 10 | 0.14 | 0.04 | 0.16 | 0.006 | 0.002 | <0.01 | 2.62 | 11.34 | 2.55 | 0.27 | 0.082 | 0.073 | 0.0001 | 0.001 | <0.001 | 0.0016 | <0.001 |
| 11 | 0.14 | 0.02 | 0.30 | 0.015 | 0.002 | — | 2.58 | 11.44 | 2.10 | 0.27 | 0.09 | 0.065 | — | — | — | — | — |

TABLE 4

| | Heat treatment | | | Mechanical property | | | | | | | |
|---|---|---|---|---|---|---|---|---|---|---|---|
| Samp. No. | Austi-nizing (° C. × h) | Quench. cool-ing | Temper-ing (° C./h) | Tensile strength (kgf/mm$^2$) | 0.2% yield strength (kgf/mm$^2$) | 0.2% yield strength (kgf/mm$^2$) | Elon-gati-on (%) | Draw-ing (%) | absorbing energy (kgf-m) | FATT (° C.) | Metal. structure |
| 8A | 1050 × 1 | oil cooling | 560 × 2 | 135.7 | 108.2 | 87.4 | 20.0 | 68.7 | 2.7 | 55 | G.S. No. 6 Full martensite |
| 8B | 1050 × 1 | oil cooling | 580 × 2 | 129.0 | 104.0 | 84.4 | 20.0 | 68.8 | 2.9 | 45 | G.S. No. 5.5 Full martensite |
| 9A | 1000 × 1 | oil cooling | 580 × 2 | 129.5 | 104.8 | 85.7 | 20.8 | 70.4 | 7.9 | 20 | G.S. No. 6 Full martensite |
| 9B | 1050 × 1 | oil cooling | 560 × 2 | 139.0 | 105.4 | 76.4 | 20.4 | 67.0 | 3.9 | 59 | G.S. No. 5.5 Full martensite |
| 9C | 1050 × 1 | oil cooling | 580 × 2 | 132.2 | 103.4 | 81.4 | 20.8 | 66.9 | 3.6 | 35 | G.S.No. 5.5 Full martensite |
| 9D | 1050 × 1 | oil cooling | 600 × 2 | 125.2 | 99.9 | 75.5 | 20.8 | 65.1 | 3.6 | 29 | G.S. No. 5.5 Full martensite |
| 9E | 1100 × 1 | oil cooling | 580 × 2 | 133.0 | 102.9 | 80.0 | 20.0 | 66.9 | 4.1 | 47 | G.S. No. 5.5 Full martensite |
| 10A | 1050 × 1 | oil cooling | 580 × 2 | 131.6 | 106.6 | 89.3 | 20.8 | 67.0 | 3.8 | 55 | G.S. No. 6 Full martensite |
| 10B | 1050 × 1 | oil cooling | 600 × 2 | 127.3 | 99.6 | 76.4 | 21.6 | 66.9 | 6.4 | 32 | G.S. No. 5.5 Full martensite |
| 11A | 1050 × 1 | oil cooling | 550 × 2 | 135.8 | 108.1 | 86.7 | 18.7 | 62.2 | 5.7 | | — |
| 11B | | | 566 × 2 | 134.8 | 104.8 | 82.2 | 18 | 62 | 6.4 | 14 | |

Figure 7:
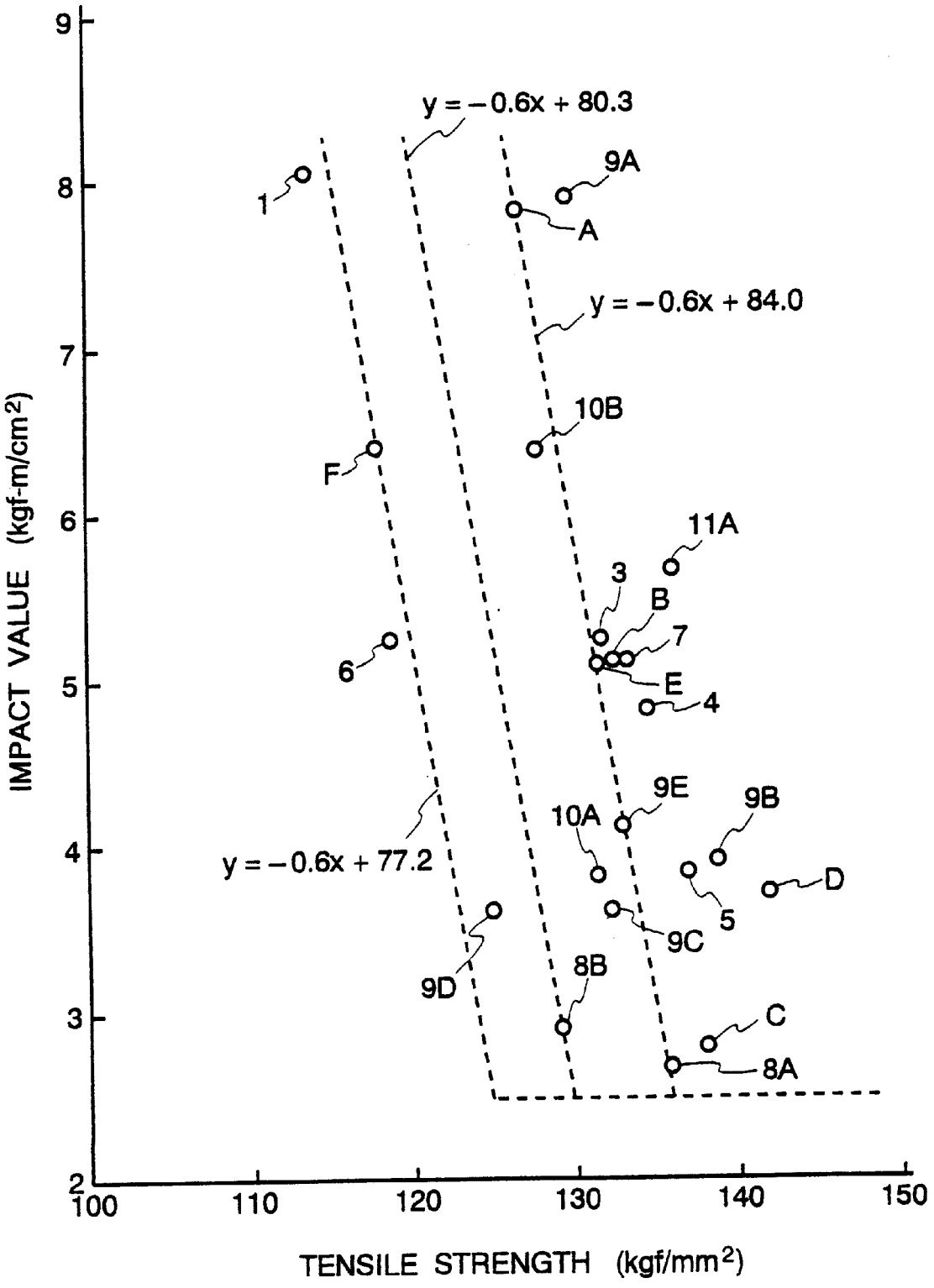
FIG. 7 is a diagram showing a relation between impact values and tensile strength.

FIG. 7 is a graph showing relations between 20° C. V-notch Charpy impact value and tensile strength, together with the samples of the embodiment 1. As shown in FIG. 7, an impact value of any sample is high and is 2.5 kgf-m/cm or more. Impact value (y) is preferable to be at least a value obtained by extracting (tensile strength (x)×0.6) from 77.2, and more preferable to be at least a value obtained by extracting (tensile strength (x)×0.6) from 80.4, and particularly preferable to be at least a value obtained by extracting (tensile strength (x)×0.6) from 84.0.

Figure 8:
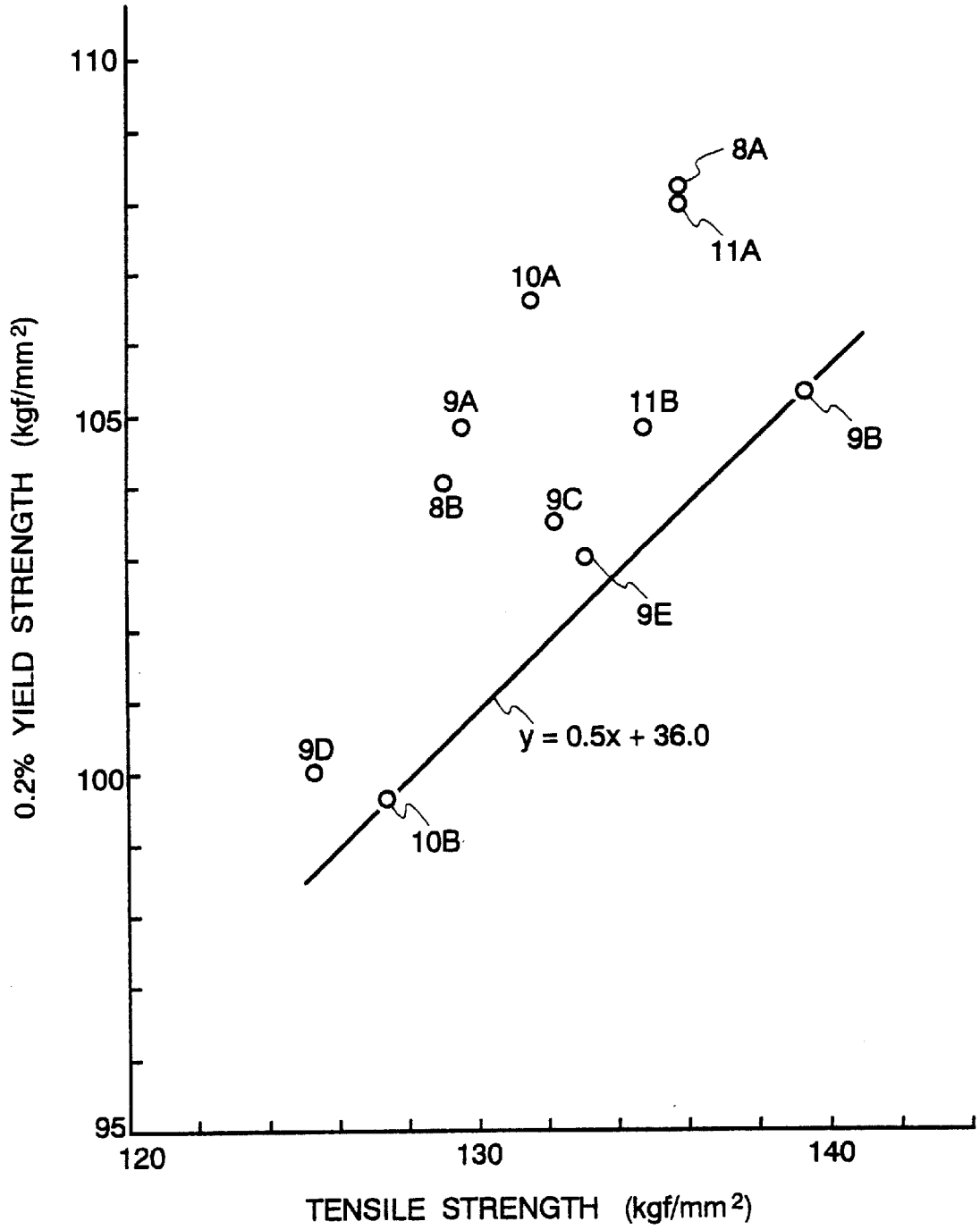
FIG. 8 is a diagram showing a relation between 0.2% yield strength and tensile strength.

FIG. 8 is a graph showing a relation between 0.2% yield strength and tensile strength. In the material according to the present invention, particularly, it is preferable that 0.2% yield strength is at least a value obtained by adding (tensile strength(x)×0.5) to 36.0.

Figure 9:
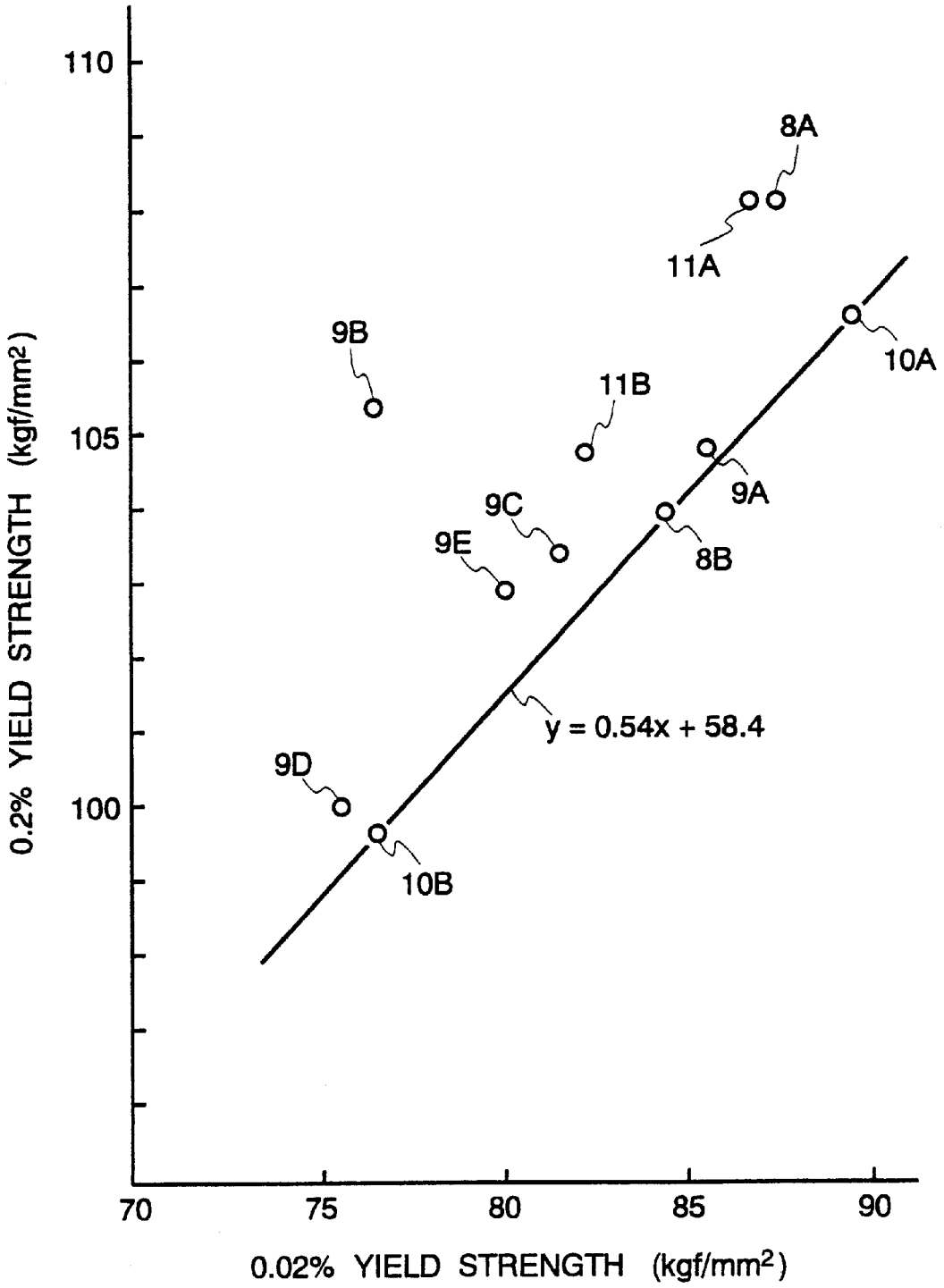
FIG. 9 is a diagram showing a relation between 0.2% yield strength and 0.02% yield strength.

FIG. 9 is a graph showing a relation between 0.02% yield strength and tensile strength. In the material according to the present invention, particularly, it is preferable that 0.2% yield strength is at least a value obtained by adding (0.02% yield strength(x)×0.54) to 58.4.

EMBODIMENT 3

Figure 11:
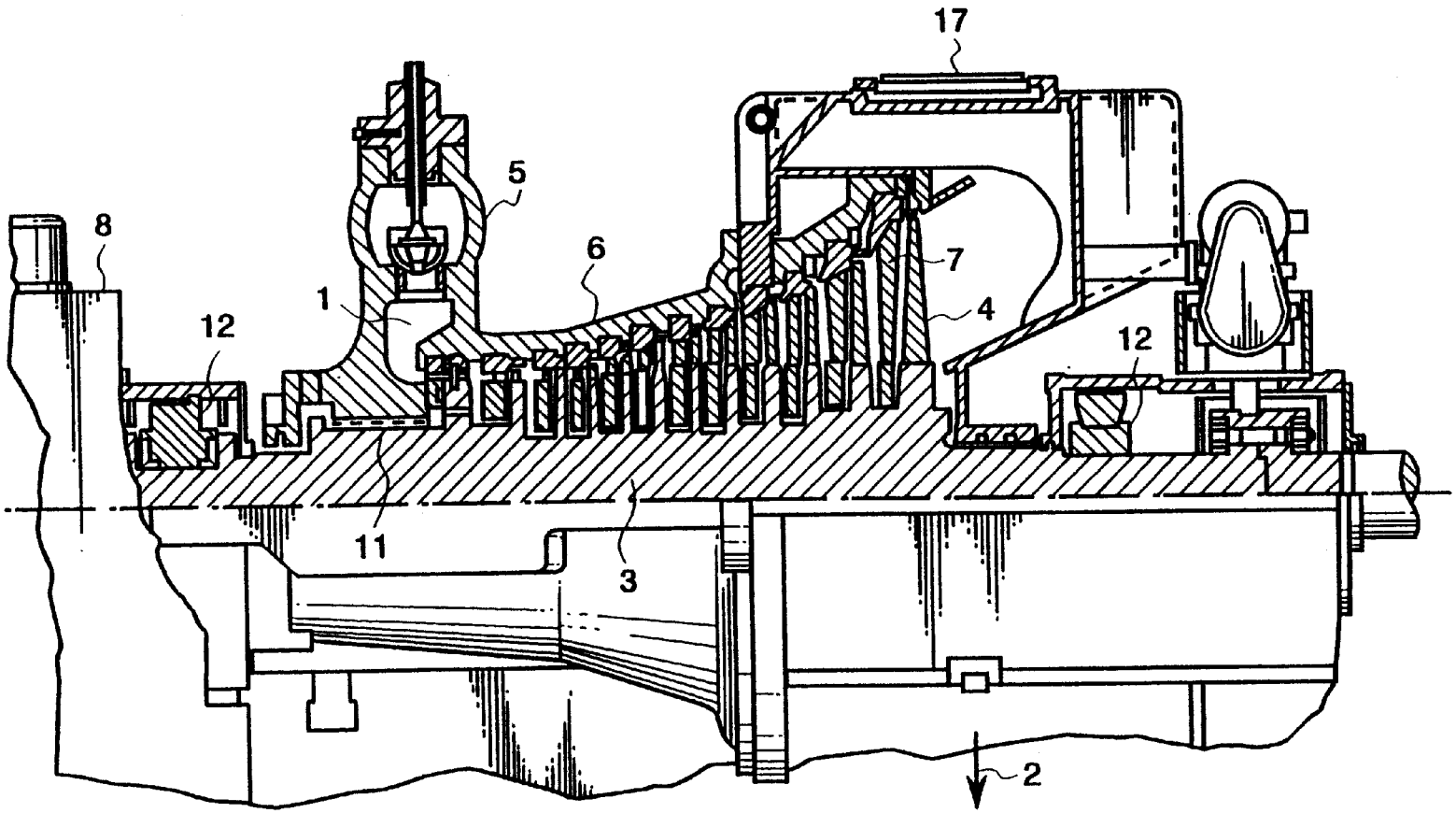
FIG. 11 is a sectional view of a high and low pressure sides-integrating steam turbine.

FIG. 11 shows a sectional view of a high and low pressure sides-integrating steam turbine according to the present invention.

In this steam turbine, an output per one turbine can be increased by raising steam pressure and temperature to 100 ata and 536° C., respectively, at a main steam inlet. In order to increase an output per one turbine, it is necessary to increase the length of the final stage blades and a flow rate of steam. For example, when the length of the final stage blades is made long from 26" to 33.5", an annulus area is increased about 1.7 times. Therefore, if an output of a conventional steam turbine is 100 MW, an output of the turbine having such long blades is increased to 170 MW. By making the blades longer into 40 inches, the output per one turbine can be increased to two or more times.

In a case where long blades of 33 inches or more or 40 inches or more are used according to power generation cycles, as a high and low pressure sides-integrated monoblock rotor shaft material, preferable is a material having tensile strength of 88 kg/mm$^2$ or more, a 538° C. $10^5$ h creep rupture strength of 15 kg/mm$^2$ or more and impact absorption energy of 2.5 kg-m(3 kg-m/cm$^2$) at room temperature from the point of view of securing safety against brittleness rupture of a low pressure side.

A middle pressure section has blades the length of which becomes gradually longer toward the low pressure side, and the blades are formed by forging of a martensite steel comprising, by weight, 0.05–0.15% C, not more than 1% Mn, not more than 0.5% Si, 10–13% Cr, not more than 0.5% Mo, not more than 0.5% Ni and the balance Fe.

The final stage has about 90 blades per one circle, the blade portion length of which is 35 inches for 60 Hz power generation, and the blades are formed by forging of a martensite steel comprising, by weight, 0.08–0.18% C, not more than 1% Mn, not more than 0.25% Si, 8–13% Cr, 2.0–3.5% Ni, 1.5–3.0% Mo, 0.05–0.35% V, 0.02–0.10% N, at least one kind, 0.02–0.2% in total, of Nb and Ta. In particular, in this embodiment, the alloy of No. 2 in the table 1 of the embodiment 1 was used. Further, in the final stage, a shield plate of Stellite for erosion prevention is provided on a leading edge portion of the tip of each blades by welding. Further, partial hardening is performed in each blade other than the provision of the shield plate. For blades for 50 Hz, the blade portion length of which is 43 inches or more, a forging material of the same martensite steel as the above is used.

These blades are fixed by fixing 4–5 blades per each stage to a shroud of the same material by caulking tenons provided on the tip of each of the blades For stationary vanes 7, the stationary vanes of until the third stage of the high pressure section are made of a martensite steel having the same compositions as the blades, but, the same material as the blade material of the middle pressure section is used for the other vanes.

For the casing 6, Cr—Mo—V cast steel is used which comprises, by weight, 0.15–0.3% C, not more than 1% Mn, not more than 0.5% Si, 1–2% Cr. 0.5–1.5% Mo, 0.05–0.2% V and not more than 0.1% Ti.

A generator 8 can generate electric power of 100, 000–200,000 kW. In this embodiment, a distance between bearings 12 of the rotor shaft is about 520 cm, the outer diameter at the final stage blades is 316 cm, and a ratio of the distance to the outer diameter is 1.65. A power generation capacity is 100,000 kW. The distance between the bearings is 0.52 m per power generation output 10,000 kW.

Further, in this embodiment, in a case where 40" blades are used for the final stage, the outer diameter of the blades is 363 cm, a ratio of the distance between the bearings to the outer diameter is 1.43. Thereby, power generation of 200, 000 kW is possible, and the distance between the bearings per 10,000 kW is 0.26 m.

A ratio of an outer diameter of a blade planting portion of the rotor shaft to the blade length in the final stage is 1.70 for 33.5" blades, and 1.71 for 40" blades.

In this embodiment, even steam temperature of 566° C. can be applied and even steam pressure of 121 ata, 169 ata and 224 ata can be applied.

A steam turbine according to the present invention has blades of 13 stages planted on a high and low pressure sides-integrated mono-block rotor shaft 3, and steam flows, at high temperature of 538° C. and high pressure of 88 ata, into between the blades from a steam inlet 1 through a steam control valve 5. The steam flows from the inlet 1 in one direction to become a temperature of 33° C. and a pressure of 722 mmHg and is exhausted from a steam outlet 2 through the final stage blades 4. The high and low pressure sides-integrated mono-block rotor shaft 3 according to the present invention is exposed to the steam of 538° C. to a fluid of 33° C., the forging steel of Ni—Cr—Mo—V having the properties described in this embodiment is used for the shaft 3. A planting portion of the rotor shaft 3 in which the blades are planted is formed in disc-shape, and integrally formed from the shaft 3 by machining. The shorter the blade length is, the longer the length of the disc portion is, whereby vibrations are made small.

Compositions of material of each part in this embodiment are as follows:

(1) Rotor shaft

Rotor shafts each are produced with shaft materials of the alloy compositions listed in the table 5 by electroslag remelting, and forged in diameter of 1.2 m. Each rotor shaft is heated to 950° C. and kept for 10 hours, and then cooled with sprayed water while rotating the rotor shaft so that a cooling speed at a central portion thereof is about 100° C./h. Next, each rotor shaft is tempered by heating to 665° C. and keeping for 40 h. Test pieces are cut out from a central portion of each rotor shaft, and a creep rupture test, V-notch impact test (cross sectional area of test piece 0.8 $cm^2$) before and after heating (500° C., 3,000 h) and tensile strength test were conducted. The test values are substantially the same as values described later.

TABLE 5

| Samp. | Compositions (wt %) | | | | | | | | | | | Si + Mn |
|---|---|---|---|---|---|---|---|---|---|---|---|---|
| No. | C | Si | Mn | P | S | Ni | Cr | Mo | V | Others | Mn/Ni | Ni |
| 21 | 0.23 | 0.08 | 0.18 | 0.012 | 0.012 | 1.85 | 1.20 | 1.21 | 0.22 | — | 0.097 | 0.141 |
| 22 | 0.24 | 0.06 | 0.07 | 0.007 | 0.010 | 1.73 | 1.38 | 1.38 | 0.27 | — | 0.040 | 0.075 |
| 23 | 0.27 | 0.04 | 0.15 | 0.007 | 0.009 | 1.52 | 1.09 | 1.51 | 0.26 | — | 0.099 | 0.125 |
| 24 | 0.30 | 0.06 | 0.19 | 0.008 | 0.011 | 0.56 | 1.04 | 1.31 | 0.26 | — | 0.339 | 0.446 |
| 25 | 0.33 | 0.27 | 0.77 | 0.007 | 0.010 | 0.34 | 1.06 | 1.28 | 0.27 | — | 2.265 | 3.059 |
| 26 | 0.23 | 0.05 | 0.30 | 0.009 | 0.012 | 3.56 | 1.66 | 0.40 | 0.12 | — | 0.084 | 0.098 |
| 27 | 0.31 | 0.07 | 0.15 | 0.007 | 0.009 | 2.00 | 1.15 | 1.32 | 0.22 | — | 0.075 | 0.110 |
| 28 | 0.26 | 0.06 | 0.17 | 0.007 | 0.008 | 1.86 | 1.09 | 1.41 | 0.24 | La + Ce 0.20 | 0.091 | 0.124 |
| 29 | 0.25 | 0.07 | 0.17 | 0.010 | 0.010 | 1.72 | 1.40 | 1.42 | 0.24 | Ca 0.005 | 0.099 | 0.140 |
| 30 | 0.24 | 0.05 | 0.13 | 0.009 | 0.007 | 1.73 | 1.25 | 1.39 | 0.25 | Zr 0.04 | 0.075 | 0.104 |
| 31 | 0.26 | 0.03 | 0.09 | 0.008 | 0.009 | 1.71 | 1.23 | 1.45 | 0.23 | AQ 0.01 | 0.052 | 0.070 |
| 32 | 0.29 | 0.09 | 0.23 | 0.013 | 0.009 | 1.70 | 1.06 | 1.32 | 0.25 | — | 0.135 | 0.188 |
| 33 | 0.29 | 0.21 | 0.33 | 0.012 | 0.007 | 1.74 | 1.04 | 1.20 | 0.23 | — | 0.190 | 0.310 |
| 34 | 0.31 | 0.25 | 0.90 | 0.010 | 0.007 | 1.86 | 1.06 | 1.29 | 0.22 | — | 0.484 | 0.618 |

(2) Blade

The length of 3 stages at a high temperature and high pressure side is 40" mm and the blade is made of forged steel of martensite steel comprising, by weight, 0.20–0.30% C, 10–13% cr, 0.5–1.5% Mo, 0.5–1.5% W, 0.1–0.3% V, not more than 0.5% Si, not more than 1% Mn and balance Fe.

The table 5 shows chemical compositions of typical samples served for tests of toughness and creep rupture of a high and low pressure integral steam turbine rotor. The samples are melted and formed in lump in a vacuum high frequency melting furnace, and hot-forged in 30 mm cross section square at a temperature of 850–1150° C. Sample Nos. 21 to 23 and 27 to 31 are materials according to the present invention, Sample Nos. 24 to 26 are melted and formed for comparison, sample No. 25 is a material corresponding to ASTM standard A470 class 8, and sample No. 26 is a material corresponding to ASTM standard A470 class 7. Those samples, which are simulated by the conditions of a central portion of a high and low pressure sides-integrated mono-block steam turbine rotor shaft, are heated to 950° C., transformed to austenitic structure, and then cooled at a speed of 100° C./h for hardening. Next, they are heated at 665° C. for 40 h and cooled thereby tempering. A Cr—Mo—V steel according to the present invention does not include any ferrite phase and it a whole bainitic structure.

A temperature at which steel of the present invention is transformed into austenitic structure is necessary to be 900–1000° C. A high toughness can be obtained at a temperature less than 900° C., but a creep rupture strength becomes low. A high creep rupture strength can be obtained at a temperature higher than 1000° C., but toughness becomes low. A tempering temperature must be 630–700° C. A high toughness can not be obtained at a temperature less than 630° C. and a high creep rupture strength can not be obtained at a temperature higher than 700° C.

Table 6 shows results of tensile strength test, impact test and creep rupture test. Toughness is expressed by V-notch Charpy impact absorption energy tested at a temperature of 20° C. A creep rupture strength is expressed by a 538° C. $10^5$ h strength obtained by a Rurson mirror method. As is apparent from the table, in the materials according to the present invention, a tensile strength at room temperature is 88 kg/mm$^2$ or more, 0.2% yield strength is 70 kg/mm$^2$ or more, FATT is 40° C. or less, impact absorption energy before or after heating is 2.5 kg-m or more and creep rupture strength is about 11 kg/mm$^2$ or more, and in any cases of which the value is high. The materials according to the present invention each are useful for high and low pressure sides-integrated mono-block steam turbine rotors. In particular, materials having strength of about 15 kg/mm$^2$ or more are better for the turbine rotors on which long blades of 33.5" are planted.

TABLE 6

| Samp. No. | Tensile strength (kg/mm$^2$) | 0.02% yield strength (kg/mm$^2$) | Elongation (%) | Drawing (%) | Impact absorbing energy (kg-m) | 50% FATT (° C.) | 538° C. creep rupture strength (kg/mm$^2$) |
|---|---|---|---|---|---|---|---|
| | | | | | Values in ( ): after heating of 500° C. 3000 h | | |
| 21 | 92.4 | 72.5 | 21.7 | 63.7 | 3.5(3.3) | 30 | 12.5 |
| 22 | 92.5 | 72.6 | 21.3 | 62.8 | 3.3(3.0) | 39 | 15.6 |
| 23 | 90.8 | 71.4 | 22.5 | 64.0 | 2.8(2.7) | 38 | 18.4 |
| 24 | 90.8 | 71.9 | 20.4 | 61.5 | 1.2 | 119 | 15.5 |
| 25 | 88.1 | 69.2 | 20.1 | 60.8 | 1.3 | 120 | 14.6 |
| 26 | 72.4 | 60.1 | 25.2 | 75.2 | 12.0 | −20 | 5.8 |
| 27 | 89.9 | 70.3 | 22.3 | 64.5 | 3.6(3.3) | 29 | 10.8 |
| 28 | 90.8 | 70.7 | 21.9 | 63.9 | 4.2 | 21 | 14.8 |
| 29 | 91.0 | 71.4 | 21.7 | 63.5 | 3.9 | 25 | 15.1 |
| 30 | 92.0 | 72.2 | 20.9 | 62.2 | 3.7 | 34 | 15.6 |
| 31 | 90.6 | 71.1 | 21.5 | 61.8 | 3.7 | 36 | 15.5 |
| 32 | — | — | — | — | 3.0(2.4) | — | — |
| 33 | — | — | — | — | 3.4(2.4) | — | — |
| 34 | — | — | — | — | 3.6(2.3) | — | — |

Further, in order to examine characteristics of brittleness of sample No. 24 and Nos. 25 (each corresponding to currently used high pressure rotor material) and No. 26 (currently used low pressure rotor material),impact test were conducted of samples before and after treatment of 500° C. for 3000 h for embrittling, and a 50% fracture appearance transition temperature (FATT) was examined. FATT is increased (which means to be made brittle) from 119° C. to 135° C. (ΔFATT=16° C.) in No.25, from −20° C. to 18° C. (ΔFATT=38° C.) in No. 26 by the embrittling treatment. On the contrary, it was confirmed that FATT of the sample No. 23 according to the present invention is 38° C. before and after the brittleness making treatment, that is, not made brittle.

Sample Nos. 28 to 31 have rare-earth elements of (La—Ce), Ca, Zr and Al, added thereto, respectively and toughness of each of the samples is increased by adding the element or elements. Particularly, an addition of rare-earth elements is effective for improving the toughness.

A material having Y added thereto other than La—Ce also was examined, as a result, it was confirmed that the addition brought an effect of remarkably improving the toughness.

Further, a high creep rupture strength of 12 kg/mm$^2$ or more can be obtained by reducing $O_2$ to an amount of 100 ppm or less, particularly, 15 kg/mm$^2$ or more by reducing it 80 ppm or less and 18 kg/mm$^2$ or more by reducing it 40 ppm or less.

A 538° C. $10^5$ h creep rupture strength has a tendency to decrease according to an increase in an amount of Ni, particularly, the strength becomes about 11 kg/mm$^2$ or more when an amount of Ni is 2% or less, more particularly, 12 kg/mm$^2$ or more is exhibited at an amount of Ni of 1.9% or less.

Figure 10:
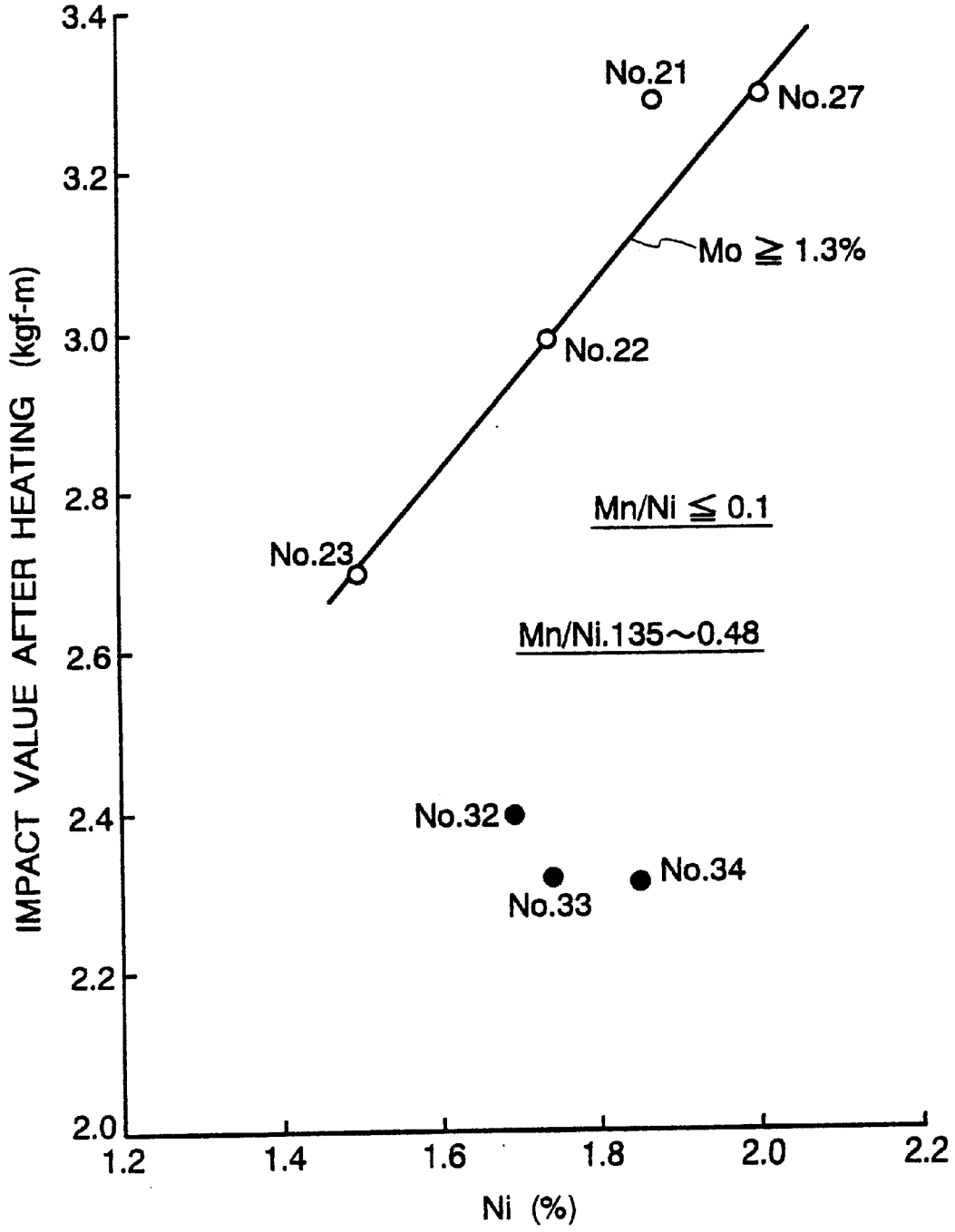
FIG. 10 is a diagram showing a relation between impact values after heating and Ni.

FIG. 10 is a graph showing a relation between impact values after heating for 3000 h and an amount of Ni. As shown in FIG. 10, the materials, of which a ratio of (Si+Mn)/Ni is 0.18 or less or a ratio of Mn/Ni is 0.12 or less, have a high impact value according to an increase in an amount of Ni, however, a material or materials of the comparison samples No. 12 to No. 14, of which a ratio of (Si+Mn)/Ni is more than 0.18 or a ratio of Mn/Ni is more than 0.12, has a low impact value of 2.4 kg-m or less, and even if an amount of Ni becomes high, it influences little on the impact value. It is apparent that an influence of Mn or (Si+Mn) on the impact value is very large at a specific amount of Ni. When an amount of Mn is 0.2% or less or an amount of (Si+Mn) is 0.25% or less, a very high impact value is presented. Therefore, when a ratio of (Si+Mn)/Ni is 0.18 or less or a ratio of Mn/Ni is 0.12 or less, a high impact value of 2.5 kg-m or more is presented.

Until a composition ratio between (V+Mo)/(Ni+Cr) relating to creep rupture strength and impact absorption energy reaches about 0.7, wherein V and Mo are elements forming carbides and Ni and Cr are elements improving hardenability, the creep rupture strength and the impact absorption energy increase as the composition ratio (V+Mo)/(Ni+Cr) increases. The impact absorption energy becomes low as the above composition ratio becomes larger. Toughness and creep rupture strength, which are necessary for the high and low pressure sides-integrated mono-block turbine rotor can be made excellent in their property by making the composition ratio (V+Mo)/(Ni+Cr) into a range of 0.45–0.7.

Relations between impact values after heating for making brittle and an amount of Mn or an amount of (Si+Mn) of material containing 1.6–1.9% Ni were examined. As a result, it was found that an influence of an amount of Mn or an amount of (Si+Mn) on impact value is very large at a specific amount of Ni, and a very large impact value is presented at 0.2% or less of Mn or at 0.07–0.25% of (Si+Mn).

Relations between impact values and a ratio Mn/Ni or (Si+Mn)/Ni in material containing 1.52–2.0% Ni were examined, as a result, it was found that a high impact value of 2.5 kg-m or more was presented when the ratio of Mn/Ni is 0.12 or less, the ratio of (Si+Mn)/Ni is 0.04–0.18.

EMBODIMENT 4

Table 7 is chemical compositions (by weight %) of typical samples relating to high and low pressure integral steam turbine rotor shaft according to the present invention.

TABLE 7

| Samp. | Compositions (wt %) | | | | | | | | | | | | (ppm) | Ni | Cr | Mn |
|---|---|---|---|---|---|---|---|---|---|---|---|---|---|---|---|---|
| No. | C | Si | Mn | P | S | Ni | Cr | Mo | W | V | Nb | Others | $O_2$ | Mo | Mo | Ni |
| 41 | 0.33 | 0.27 | 0.77 | 0.007 | 0.010 | 0.34 | 1.06 | 1.28 | — | 0.27 | — | — | 26 | 0.27 | 0.83 | 2.26 |
| 42 | 0.23 | 0.05 | 0.30 | 0.009 | 0.012 | 3.56 | 1.66 | 0.40 | — | 0.12 | — | — | 20 | 8.90 | 4.15 | 0.084 |
| 43 | 0.26 | 0.02 | 0.16 | 0.003 | 0.004 | 1.84 | 1.95 | 1.10 | — | 0.27 | — | — | 18 | 1.67 | 1.77 | 0.092 |
| 44 | 0.24 | 0.02 | 0.18 | 0.001 | 0.006 | 1.90 | 1.91 | 1.18 | — | 0.29 | 0.03 | — | 10 | 1.61 | 1.62 | 0.106 |
| 45 | 0.23 | 0.03 | 0.19 | 0.002 | 0.006 | 1.65 | 1.88 | 1.11 | 0.20 | 0.26 | — | — | 18 | 1.67 | 1.69 | 0.103 |
| 46 | 0.24 | 0.02 | 0.19 | 0.001 | 0.007 | 1.89 | 1.92 | 1.10 | 0.23 | 0.26 | 0.03 | — | 20 | 1.72 | 1.75 | 0.101 |
| 47 | 0.22 | 0.04 | 0.18 | 0.009 | 0.008 | 1.83 | 1.65 | 1.16 | 0.28 | 0.26 | — | Ti 0.03<br>B 0.004 | 20 | 1.58 | 1.59 | 0.098 |
| 48 | 0.24 | 0.05 | 0.19 | 0.005 | 0.007 | 1.85 | 1.97 | 1.18 | — | 0.28 | 0.05 | Ca 0.008 | 18 | 1.57 | 1.68 | 0.103 |
| 49 | 0.26 | 0.03 | 0.19 | 0.008 | 0.010 | 1.89 | 1.99 | 1.20 | — | 0.26 | 0.04 | La 0.08<br>Ce 0.08 | 18 | 1.58 | 1.66 | 0.101 |
| 50 | 0.23 | 0.05 | 0.24 | 0.006 | 0.008 | 1.90 | 1.91 | 1.16 | 0.24 | 0.26 | — | Al 0.008 | 16 | 1.65 | 1.65 | 0.126 |
| 51 | 0.26 | 0.05 | 0.18 | 0.007 | 0.006 | 1.80 | 1.90 | 1.23 | — | 0.24 | — | Ta 0.08 | 12 | 1.46 | 1.54 | 0.100 |
| 52 | 0.25 | 0.04 | 0.18 | 0.009 | 0.009 | 1.86 | 1.69 | 1.23 | 0.14 | 0.26 | — | Zr 0.30 | 16 | 1.51 | 1.37 | 0.097 |

Sample Nos. 41 and 42 are conventional steels used for high pressure rotor shafts and low pressure rotor shafts, respectively. Nos. 43–52 are steels of the present invention. Each steel of the present invention is melted in high frequency vacuum melting furnace, formed into lump and then hot-forged at 900–1150° C. Simulating the conditions of a central portion of a high and low pressure integrated steam turbine rotor shaft, those sample were heated to transform into austenitic structure, and then cooled at a speed 100° C./h to effect hardening. Next, they were heated at 665° C. for 40 h, cooled in the furnace thereby effecting a tempering treatment. A Ni—Cr—Mo—V steel of the present invention was whole bainitic structure without containing any ferrite phase.

A temperature at which the steel of the present invention is transformed into austenitic structure is necessary to be 870–1000° C. The heating temperature of less than 870° C. can obtain a high toughness, but creep rupture strength becomes low. When the temperature is higher than 1000° C., a high creep strength can be obtained, but the toughness becomes low. Tempering temperature is necessary to be 610–700° C. The heating temperature of less than 610° C. can not obtain a high toughness, and when it is higher than 700° C., a high creep rupture strength can not be obtained.

Table 8 is test results of tensile strength, impact, and notch creep rupture tests. The toughness is expressed by V-notch Charpy impact absorption energy tested at a temperature of 20° C. The creep rupture strength is expressed by a 538° C. $10^5$ h strength obtained by Raruson mirror method. As is apparent from the table, the materials of the present invention each have a tensile strength of 88 kg/mm$^2$ or more at room temperature, a 0.2% yield strength of 70 kg/mm$^2$ or more, FATT of 40° C. or less, impact absorption energy before and after heating of 2.5 kg-m or more and creep rupture strength of 12 kg/mm$^2$ or more, which are excellent values, and the materials are very useful for high and low pressure sides-integrated mono-block turbine rotors. In particular, the material having about 15 kg/mm$^2$ or more is better for the turbine rotor having blades of 33.5" length.

TABLE 8

| Samp. No. | Tensile strength (kg/mm$^2$) | Elong-ation (%) | Drawing (%) | Impact absorbing energy (kg-m) | 50% FATT (° C.) | 538° C. notch creep rupture strength (kg/mm$^2$) |
|---|---|---|---|---|---|---|
| 41 | 88.1 | 20.1 | 80.8 | 1.3 | 120 | 14.0 |
| 42 | 72.4 | 25.2 | 75.2 | 12.0 | −20 | 6.5 |
| 43 | 88.9 | 21.4 | 70.9 | 8.9 | 35 | 17.5 |
| 44 | 89.0 | 21.9 | 71.8 | 9.8 | 28 | 18.8 |
| 45 | 88.5 | 23.6 | 73.0 | 6.8 | 39 | 19.8 |
| 46 | 88.8 | 21.8 | 72.3 | 7.8 | 34 | 18.4 |
| 47 | 89.8 | 21.8 | 71.4 | 10.6 | 5 | 19.3 |
| 48 | 88.8 | 22.8 | 72.8 | 11.9 | −2 | 18.8 |
| 49 | 88.5 | 22.9 | 72.8 | 13.9 | −9 | 19.8 |
| 50 | 91.8 | 20.0 | 70.8 | 10.9 | 3 | 18.4 |

TABLE 8-continued

| Samp. No. | Tensile strength ($kg/mm^2$) | Elong-ation (%) | Drawing (%) | Impact absorbing energy (kg-m) | 50% FATT (° C.) | 538° C. notch creep rupture strength ($kg/mm^2$) |
|---|---|---|---|---|---|---|
| 51 | 91.8 | 20.4 | 70.2 | 12.0 | −3 | 19.5 |
| 52 | 90.8 | 20.8 | 70.8 | 11.2 | 0 | 18.8 |

Samples Nos. 47–52 each have rare-earth elements (La—Ce), Ca, Zr and Al added thereto, and toughness increases by adding those elements. In particular, an addition of the rare-earth elements is effective for improving the toughness. A material with Y added thereto other than the rare-earth metal (La—Ce) was examined and it was confirmed that the material also had a remarkable effect of improving the toughness.

Further, a ratio of Ni/Mo is 1.25 or more and a ratio of Cr/Mo is 1.1 or more, or a ratio of Cr/Mo is 1.45 or more, or a ratio of Cr/Mo is a value or more obtained by (−1.11×(Ni/Mo)+2.78), whereby the whole is subjected to the same heat treatment and a high 538° C. $10^5$ h creep rupture strength of a 12 $kg/mm^2$ or more can be obtained.

Figure 12:
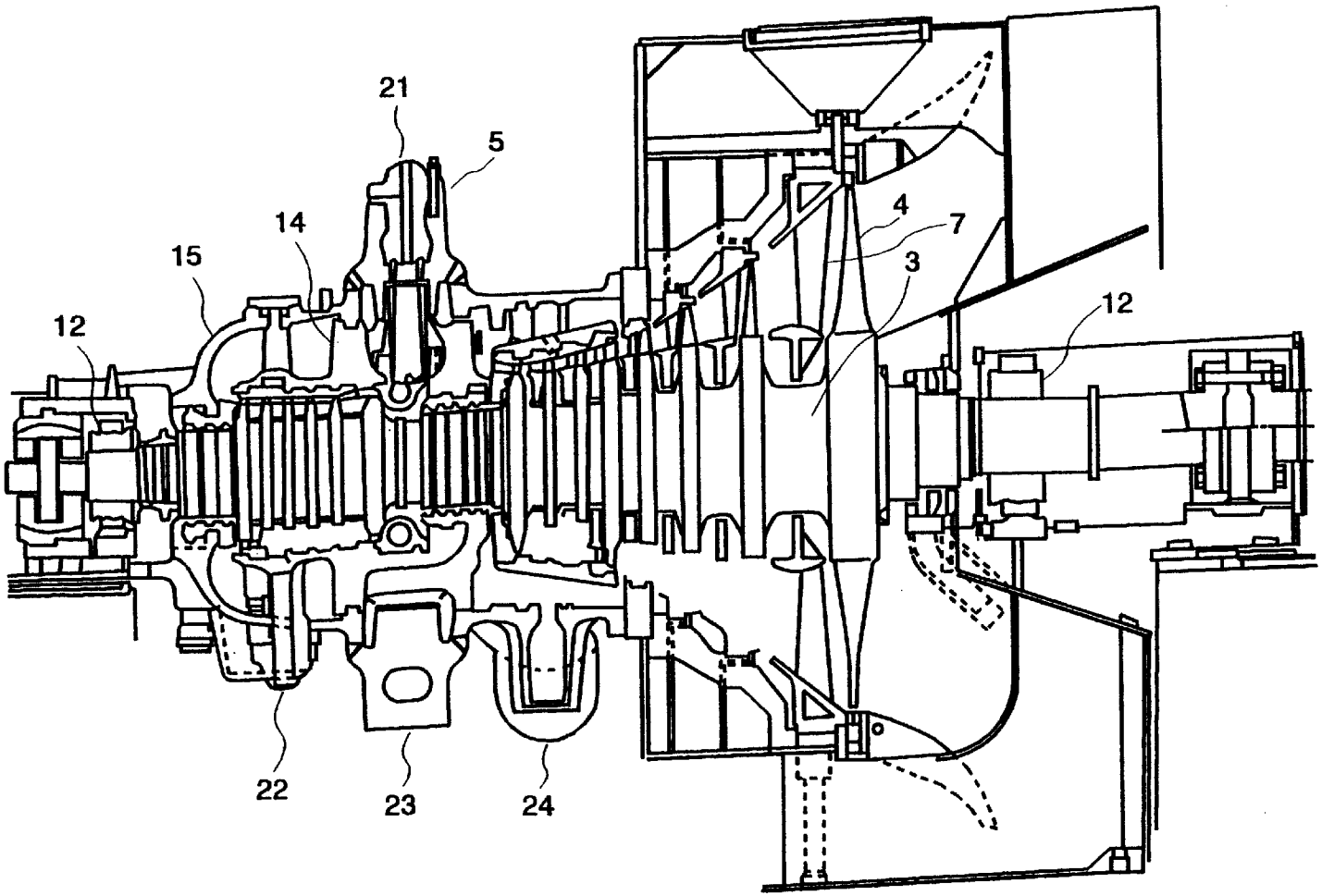
FIG. 12 is a sectional view of a high and low pressure sides-integrating steam turbine.

FIG. 12 shows a partially sectional view of reheating type high and low pressure sides-integrating steam turbine according to the present invention.

The steam turbine according to the present invention is a reheating type and has 14 stages of blades 4 planted on the high and low pressure sides-integrate mono-block rotor shaft 3, that is, 6 stages of a high pressure section or side, 4 stages of a middle pressure section or side and 4 stages of a low pressure section or side. A high pressure steam flows into a high temperature and high pressure side at 538° C. and 169 atg from a steam inlet 21 through a control valve 5 as mentioned previously. The steam flows in a left direction of FIG. 12 from the steam inlet and goes out from a high pressure steam outlet 22, and the steam is heated again to 538° C. and then sent from a reheated steam inlet 23 to a middle pressure turbine section. The steam which entered the middle pressure turbine section is sent to a low pressure turbine section together with steam from a low pressure steam inlet 24. The steam is turned into a steam of 33° C. and 722 mmHg and exhausted from a final stage blades 4. The high and low pressure sides-integrated mono-block rotor shaft 3 of the present invention is exposed to a temperature from 538° C. to 33° C., and a forging steel of the above-mentioned Ni—Cr—Mo—V low alloy steel is used. A portion of the shaft 3 in which the blades are planted is shaped in a disc-shape, and formed as one piece by machining the shaft 3. The shorter the length of the blades is, the longer the length of the disc portion is, whereby vibrations are reduced.

The blades 4 of the high pressure section are arranged in at least 5 stages, 6 stages in a current case. The stages other than first and second stages are arranged at the same distances therebetween, and a distance between the first stage and the second stage is 1.5 to 2.0 times the distance between the other stages. The axial thickness of the blade planting portion of the shaft 3 is the thickest at the first stage, and the thickness from the second stage to the final stage becomes gradually thicker and the thickness of the first stage is 2–2.6 times the thickness of the second stage.

The blades of the middle pressure section are arranged in 4 stages, the axial thickness of a blade planting portion in the first and final stages is the same as each other and thickest, and the thickness of the second, third, increases in turn toward a downstream side of a steam flow. The low pressure section has blades arranged in 4 stages. The axial thickness of a blade planting portion in the final stage is 2.7–3.3 times the axial thickness of a blade planting portion at a stage planting portion just at a upstream side of steam flow, and the axial thickness of the blade planting portion of the stage at just upstream side of the final stage is 1.1–1.3 times the axial thickness of the blade planting portion of the stage at just upstream side of this stage. Distances between the central portions of blades from the first stage to the fourth stage of the middle pressure section are about the same as one another, distances between the central portion of blades of the low pressure section become larger from the first stage toward the final stage. A ratio of the distance in each stage to that in the stage at the upstream side becomes larger toward the downstream side, a ratio of the distance in the first stage to that in the stage at the upstream side of the first stage of the low pressure section is 1.1–1.2 and a ratio of the distance in the final stage to that in the stage at the upstream side is 1.5 to 1.7.

The length of each blade of the middle and low pressure sides becomes gradually larger from the first stage toward the final stage. The length of each blade in each stage is 1.2–2.1 times the blade length in the stage at its upstream side, and 1.2–1.35 times and longer until the 5th stage, 1.5–1.7 times in the second stage of the low pressure section and 1.9–2.1 times in each of the third and fourth stages.

The blade length in each stage from the middle pressure section to the low pressure section in this embodiment is 2.5", 3", 4", 5", 6.3", 10", 20.7" and 40".

Reference number 14 denotes an inner casing and 15 an outer casing.

Figure 13:
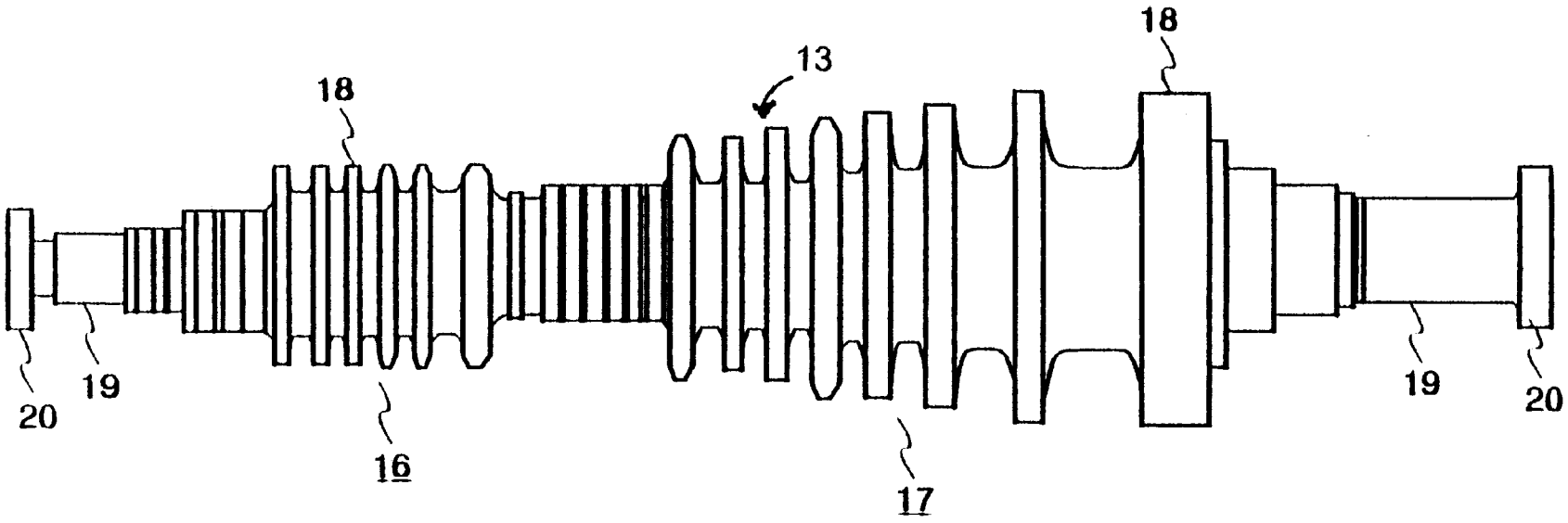
FIG. 13 is a sectional view of a rotor shaft for a high and low pressure sides-integrating steam turbine.

FIG. 13 shows a shape of a high and low pressure sides-integrated mono-block rotor shaft 3 according to the present invention. The rotor shaft 3 is formed as follows: A forging steel of alloy compositions shown in the table 9 is melted in an arc melting furnace, then poured in a ladle and then refined in vacuum by blowing Ar gas into the ladle from its lower portion, and formed in a lump.

TABLE 9

| C | Si | Mn | P | S | Ni | Cr | Mo | V | Fe |
|---|---|---|---|---|---|---|---|---|---|
| 0.23 | 0.01 | 0.20 | ≦0.005 | ≦0.005 | 1.80 | 2.01 | 1.20 | 0.27 | bal. |

(Sn ≦ 0.010, Al ≦ 0.008, Cu ≦ 0.10, Sb ≦ 0.005, As ≦ 0.008, $O_2$ ≦ 0.003)

Next, it is forged at a temperature of 900–1150° C. to be 1.7 m in maximum diameter and about 8 m in length, its high pressure side 16 is heated to 950° C. and kept for 10 h, its middle and low pressure side 17 is heated to 880° C. and kept for 10 h, and then cooled by sprayed water while rotating the rotor shaft so as to be at a cooling speed of 100° C./h at the central portion. Next, the high pressure side 16 is tempered by heating to 650° C. keeping for 40 h, and the low pressure side 17 also is tempered by heating to 625° C. and keeping for 40 h. Test pieces are cut out from a central portion of the rotor shaft, and tested by creep rupture test, V-notch impact test (sectional area of the test piece is 0.8 $cm^2$), and tensile strength test. Table 10 shows the test results.

Further, as shown in FIG. 13, blade planting portion 18 of the high pressure side 16, and middle and low pressure side 17 have the thickness and distance as mentioned above. Reference number 19 denotes bearing portions and 20 a coupling.

TABLE 10

| | | High pressure section | Low pressure section |
|---|---|---|---|
| Tensile | R.B. | ≧77.3 | ≧87.8 |
| strength ($kg/mm^2$) | C.C. | ≧73.8 | ≧87.8 |
| Yield | R.B | ≧59.7 | ≧72.0 |
| strength ($kg/mm^2$) | C.C | ≧56.2 | ≧72.0 |
| Elongation | R.B | ≧14 | ≧17 |
| percentage (%) | L.B | ≧17 | ≧17 |
| | C.C | ≧14 | ≧17 |
| Drawing | R.B | ≧40 | ≧50 |
| rate (%) | L.B | ≧45 | ≧50 |
| | C.C. (L.B.) | ≧40 | ≧50 |
| Impact value | R.B. | ≧0.82 | ≧6.22 |
| (kg-m) | C.C. (R.B.) | ≧0.69 | ≧4.83 |
| FATT (° C.) | R.B. | ≦121 | ≦−1.0 |
| | C.C. (R.B.) | ≦135 | ≦10 |
| Creep | 550° C., 30 $kg/mm^2$ | ≧186 h | |
| rupture | 600° C., 20 $kg/mm^2$ | ≧394 h | |
| strength | 645° C., 10 $kg/mm^2$ | ≧690 h | |
| Heat | Hardening (spray, | 950° C. ± | 880° C. ± |
| treat- | impulse cooling) | 10° C. | 10° C. |
| ment | Tempering | ≧648° C. | ≧590° C. |

Diameters of moving blade portions and stationary vane portions of the high pressure section the same in each stage. The diameter of the moving blade portion from the middle pressure section to the low pressure section becomes gradually larger, the diameter in the stationary vane portion the same from the fourth stage to the sixth stage, the same from the sixth stage to eighth stage and becomes larger from the eighth stage toward the final stage.

The thickness of a blade planting portion of the final stage in the axial direction is 0.3 times the length of the blade portion, and the thickness is preferable to be 0.28 to 0.35 times the length.

The rotor shaft has a maximum blade portion diameter at the final stage, the diameter is 1.72 times the blade portion length, and it is preferable to be 1.60–1.85 times.

Further, the length between the bearings is preferable to be 1.65 times the diameter formed by the tip portions of final stage blades.

In this embodiment, the generator can generate 100,000–200,000 kW. The distance between the bearings 19 of the rotor shaft in this embodiment is about 520 cm, the outer diameter of the final blades is 316 cm, and a ratio of the distance between the bearings to the outer diameter is 1.65. The distance (length) between the bearings is 0.52 m per an output of 10,000 kW.

Further, the outer diameter of the tip portions of the final blades is 365 cm in a case where the final stage blades each have a 40" length, and a ratio of the distance between the bearings to the outer diameter is 1.43. Thereby, an output of 200,000 kW is possible, and the distance between the bearings per 10,000 kW is 0.26 m.

A ratio of the outer diameter of a blade planting portion of the rotor shaft to the length of the final stage blades is 1.70 when the blades have 33.5" length, and 1.71 when they have 40" length.

This embodiment can be applied even if a steam temperature is 566° C., and each steam pressure of 121 ata, 169 ata and 224 ata can be applied.

EMBODIMENT 5

Figure 14:
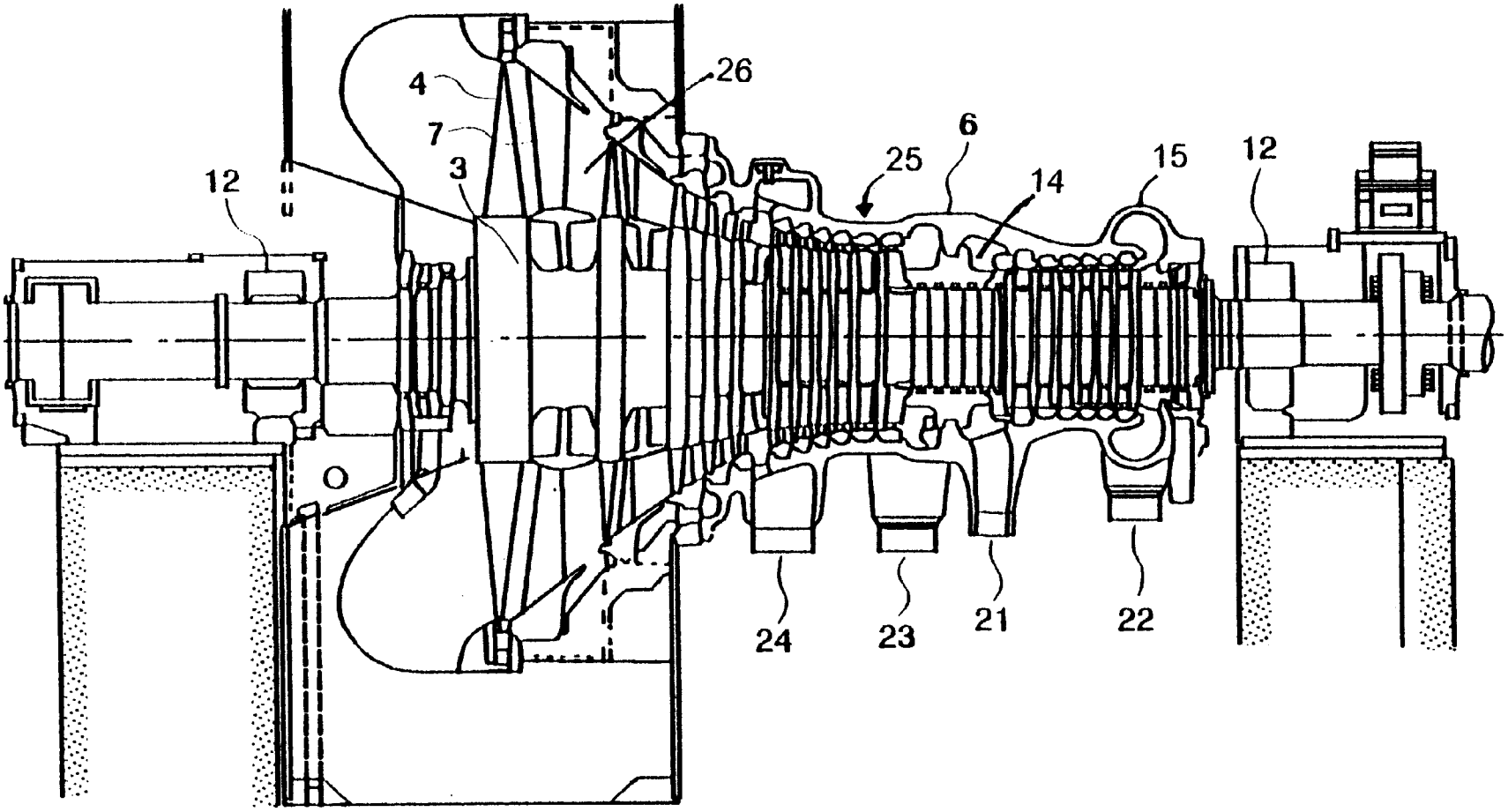
FIG. 14 is a sectional view of a high and low pressure sides-integrating steam turbine.

FIG. 14 is a sectional view showing an example of a reheating type high and low pressure sides-integrating steam turbine construction.

In the steam turbine, 126 ata a steam of 538° C. and 126 ata enters at an inlet 21, turns to be 367° C. and 38 ata and is exhausted from a high pressure steam outlet 22 through a high pressure section of a high and low pressure integral rotor shaft 3. Steam heated to 538° C. and 35 atg by a reheater enters a middle pressure section of the rotor shaft 3 from a reheated steam inlet 23, flows into a low pressure section and turns to be a steam of about 46° C. and 0.1 atg, and then exhausted from an outlet. A part of the steam, which goes out from the high pressure steam outlet 22, is used as a heat source, and supplied again from a low pressure steam inlet 24 as a heat source of the turbine.

In this embodiment, also, as material of the high and low pressure sides-integrated mono-block rotor shaft 3, blades 4, stationary vanes 7 and a casing 6, the same material as in the embodiments 2 or 3 is used. Blades of 43" are used in the final stage, and a power generation output is 1,250,000 kW. The final stage blades are made of the same martensite steel as in the embodiment 3. A distance between bearings of the rotor shaft 3 is about 655 cm, a diameter by the final stage blades of 43" is 382 cm, and a ratio of the distance to the diameter is 1.72.

The steam turbine according to the present invention is a reheating type and has a plurality of blades 4 planted on the high and low pressure sides-integrated mono-block rotor shaft 3 in 7 stages at a high pressure side, 6 stages in a middle pressure side and 5 stages at a low pressure side, that is, 18 stages in total. A high pressure steam flows into a high temperature and high pressure side at 538° C. and 169 atg from the steam inlet 21 through a control valve as mentioned previously. The high pressure steam flows in one direction from the steam inlet and goes out from the high pressure steam outlet 22, and the steam is heated again and then sent from the reheated steam inlet 23 to the middle pressure turbine section. The steam which entered the middle pressure turbine section is sent to the low pressure turbine section together with steam from the low pressure steam inlet 24. The steam is turned into a steam of 33° C. and 722 mmHg and exhausted from the final stage blades 4. The high and low pressure sides-integrated mono-block rotor shaft 3 of the present invention is exposed to a temperature from 538° C. to 33° C. A forging steel of the above-mentioned Ni—Cr—Mo—V low alloy steel is used. A portion of the shaft 3 in which the blades are planted is shaped in a disc-shape, and formed as one piece by machining the shaft 3. The shorter the length of the blades is, the longer the length of the disc portion is, whereby vibrations are reduced.

The blades 4 of the high pressure turbine section are arranged in 7 stages or at least 5 stages. The stages from the first stage to the stage just before the final stage are arranged at the same distances therebetween, and a distance between the final stage and the stage just before the final stage is 1.1 to 1.3 times the distance between the other stages than the first stage. The axial thickness of the blade planting portion of the shaft 3 is the thickest at the first and final stages, and the thickness is substantially the same in the other stages than the first and final stages. The thickness of the first stage is 2–2.6 times the thickness of the second stage.

The blades of the middle pressure section are arranged in 6 stages, the distance between the blade centers is largest at the first and second stages and it is the substantially the same from the second stage to the final stage. The distance between the first and second stages is 1.1–1.5 times the distance between the other stages.

The low pressure section has blades arranged in 5 stages. Distances between the central portions of stage blades increase gradually from the first stage to the final stage, and the final stage is 4.0–4.8 times the first stage. The thickness of a blade planting portion in the axial direction is the thickest in the final stage, becomes smaller stepwise from the final stage toward the upstream side of the steam flow, and the axial thickness of the final stage is 2.0–2.8 times that in the stage on the upstream side of the final stage, and the axial thickness of the blade planting portion of the stage just on the upstream side of the final stage is 1.0–1.5 times the axial thickness of the blade planting portion of the stage just on the upstream side of this stage. The first stage has a thickness 0.20–0.25 times that of the finals stage.

The length of blade portion of each blade becomes gradually longer from the first stage to the final stage in the low pressure section, the blade length in the final stage is 43", and the blade length of the final stage is 1.8–2.2 times that of the stage at a just upstream side of the final stage. The blade length of the stage just before the final stage is 1.7–2.1 times that of the stage just before that stage and the blade length of the stage just before that stage is 1.1–1.5 times that of the stage just before the above last mentioned stage.

The length of each blade of the middle pressure section becomes gradually larger from the first stage toward the final stage. The length of final stage blades is 3–3.5 times the blade length of the first stage blades.

The blade length in each stage from the middle pressure section 25 to the low pressure section 26 in this embodiment is 1.6", 2.1", 2.1", 2.6", 3", 4.7", 6.2", 9.3", 11.9", 22.2" and 43".

Reference number 14 denotes an inner casing and 15 an outer casing.

Figure 15:
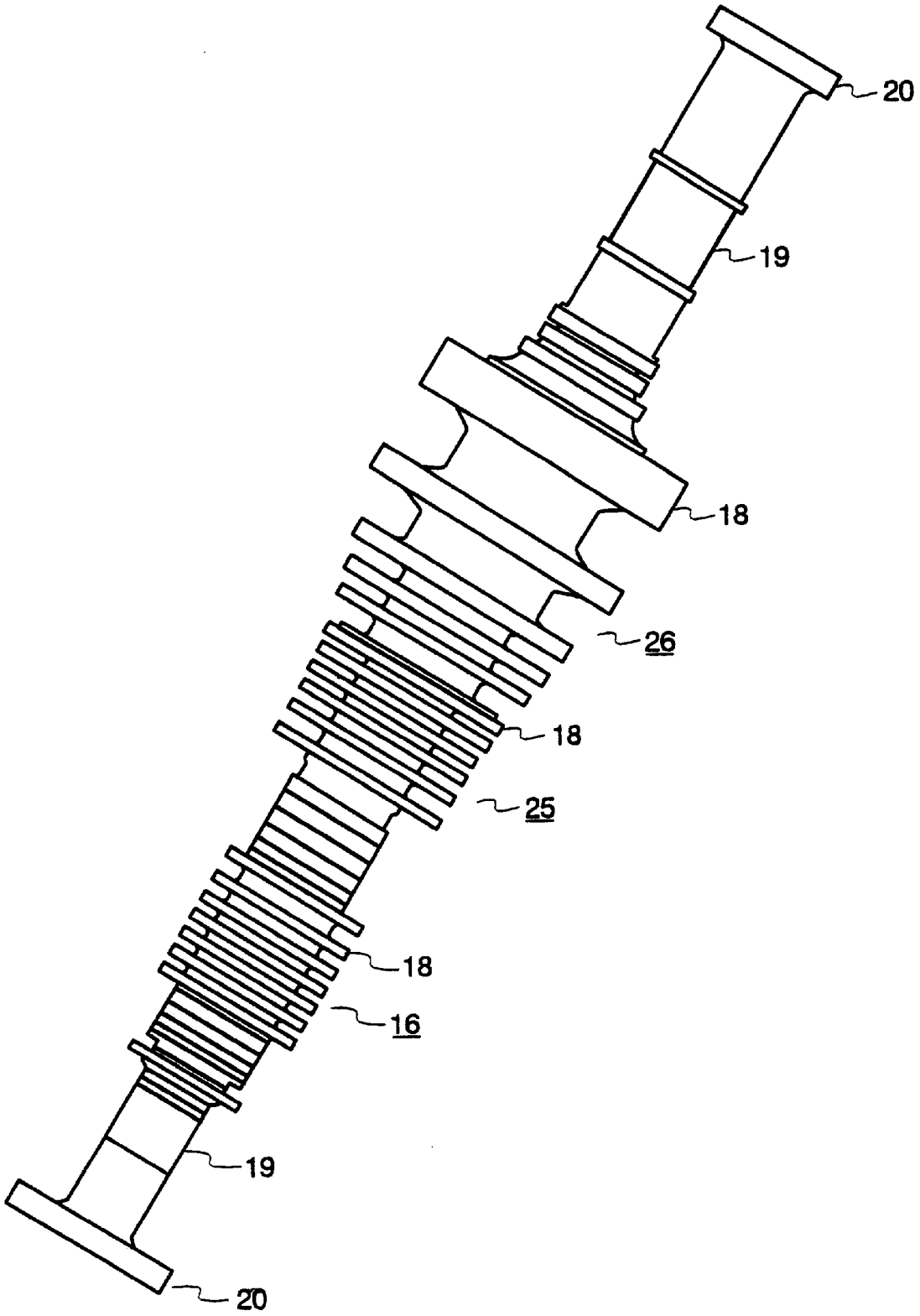
FIG. 15 is a sectional view of a rotor shaft for a high and low pressure sides-integrating steam turbine.

FIG. 15 shows a shape of another high and low pressure sides-integrated mono-block rotor shaft 3 according to the present invention.

The rotor shaft 3 in this embodiment is formed as follows: A forging steel of substantially the same alloy compositions as in the table 9 is produced and forged in the same manner in the embodiment 4 to be 1.7 m in maximum diameter and about 8 m in length. Its high and middle pressure sides are heated to 950° C. and kept for 10 h and its low pressure side is heated to 880° C. and kept for 10 h, and then cooled with sprayed water while rotating the rotor shaft so as to be a cooling speed of 100° C./h at the central portion. Next, the high and middle pressure sides are tempered by heating to 655° C. and keeping for 40 h, and the low pressure side also is tempered by heating to 620° C. and keeping for 40 h. Test pieces are cut out from a central portion of the rotor shaft, and tested by creep rupture test, V-notch impact test (sectional area of the test piece is 0.8 $cm^2$), and tensile strength test. The test results are the same as in the embodiment 4.

The diameter of the final stage blades portion is 380 cm, a ratio of the distance between bearings to the diameter is 1.72, and it is preferable to be 1.60–1.85. The distance between bearings per power generation output of 10,000 kW is 0.52 m and preferable to be 0.45–0.70.

Diameters of moving blade portions and stationary vane portions in the high and middle pressure sides the same in each stage. The diameter of the moving blade portion in the final stage of the middle pressure is a little larger, the diameter in the low pressure section becomes gradually stepwise larger in the moving blade portion and the stationary vane portion. Further, the thickness of a blade planting portion in the axial direction is 0.30 times the length of the final stage blade portion, and the thickness is preferable to be 0.28 to 0.32 times the length. The blade planting portion diameter at the final stage is 1.50 times the blade portion length, and preferable to be 1.46–1.55 times.

Figure 16:
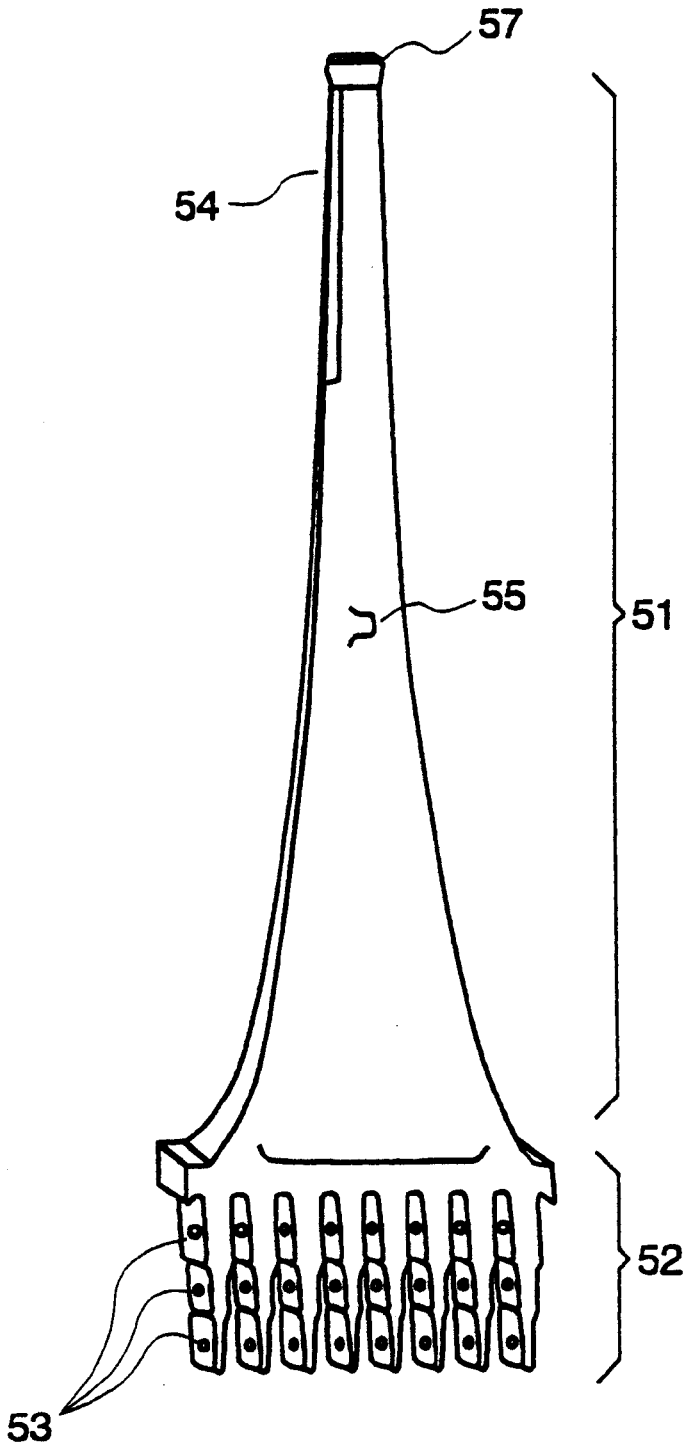
FIG. 16 is a perspective view of a final stage blade.

FIG. 16 is a perspective view of a final stage blade, the blade portion length of which is 1092 mm (43").

In FIG. 16, reference number 51 denotes a blade portion on which high speed steam impinges, 52 a or mounting portion into the rotor shaft, 53 holes for inserting pins for supporting centrifugal force of the blades, 54 an erosion shield (a Stellite plate of Co-base alloy is joined by welding) for preventing erosion by water drops in steam, and 57 a cover. In this embodiment, the blade is forged as one piece and then formed by machining. The cover can be mechanically formed as one piece with the blade.

43" long blades each were melted and formed by an electroslag remelting method, forged and subjected to heat treatment. The forging was effected in a range of 850–1150° C., and the heat treatment was effected under the conditions (hardening: 1050° C., primary tempering: 560° C. and secondary tempering: 580° C.) as in the embodiment 1. Sample No. 7 of the table 1 shows chemical compositions of this long blade material. The metallurgical structure of this long blade was wholly tempered martensite structure.

No. 7 of the table 1 has an excellent room temperature tensile strength and 20° C. V-notch Charpy impact value. It was confirmed that this 43" long blade has required mechanical properties, that is, a tensile strength of 128.5 $kgf/mm^2$ or more and 20° C. V-notch Charpy impact value of 4 $kgf\text{-}m/cm^2$ or more, and sufficiently satisfied mechanical properties.

Figure 17:
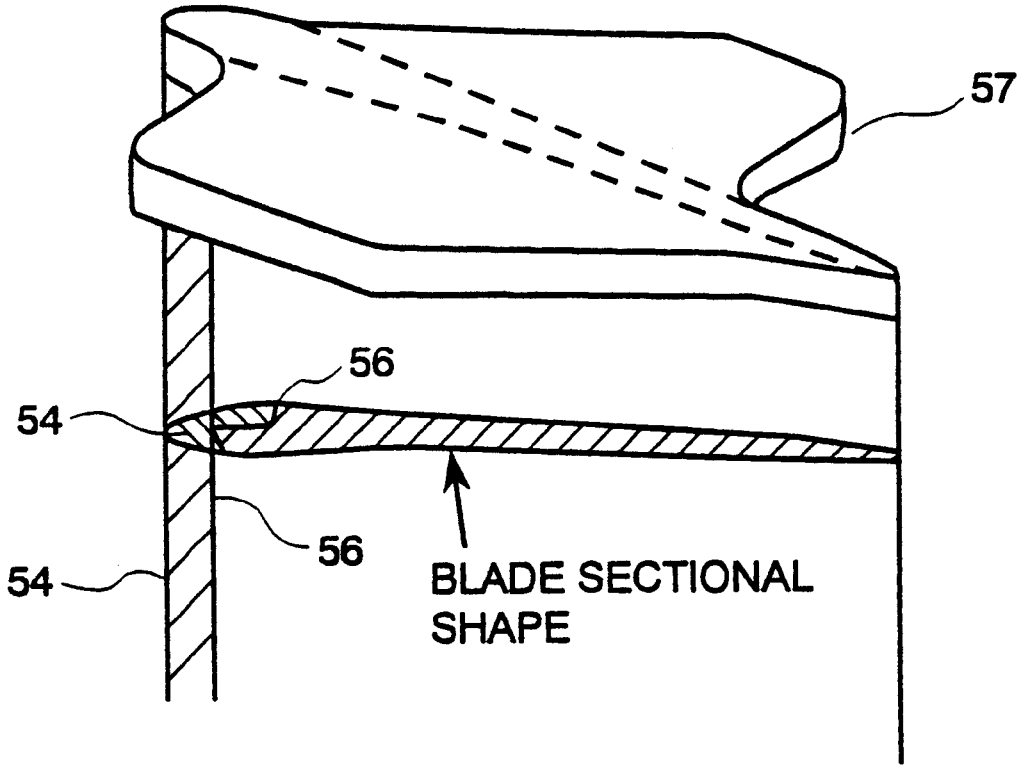
FIG. 17 is a perspective view of a tip portion of a blade.

FIG. 17 is a perspective view sectioned in part showing a condition in which an erosion shield (Stellite alloy) 54 is joined by electron beam welding or TIG welding 56. As shown in FIG. 17, the shield 54 is welded at 2 position, front and back sides.

EMBODIMENT 6

Figure 18:
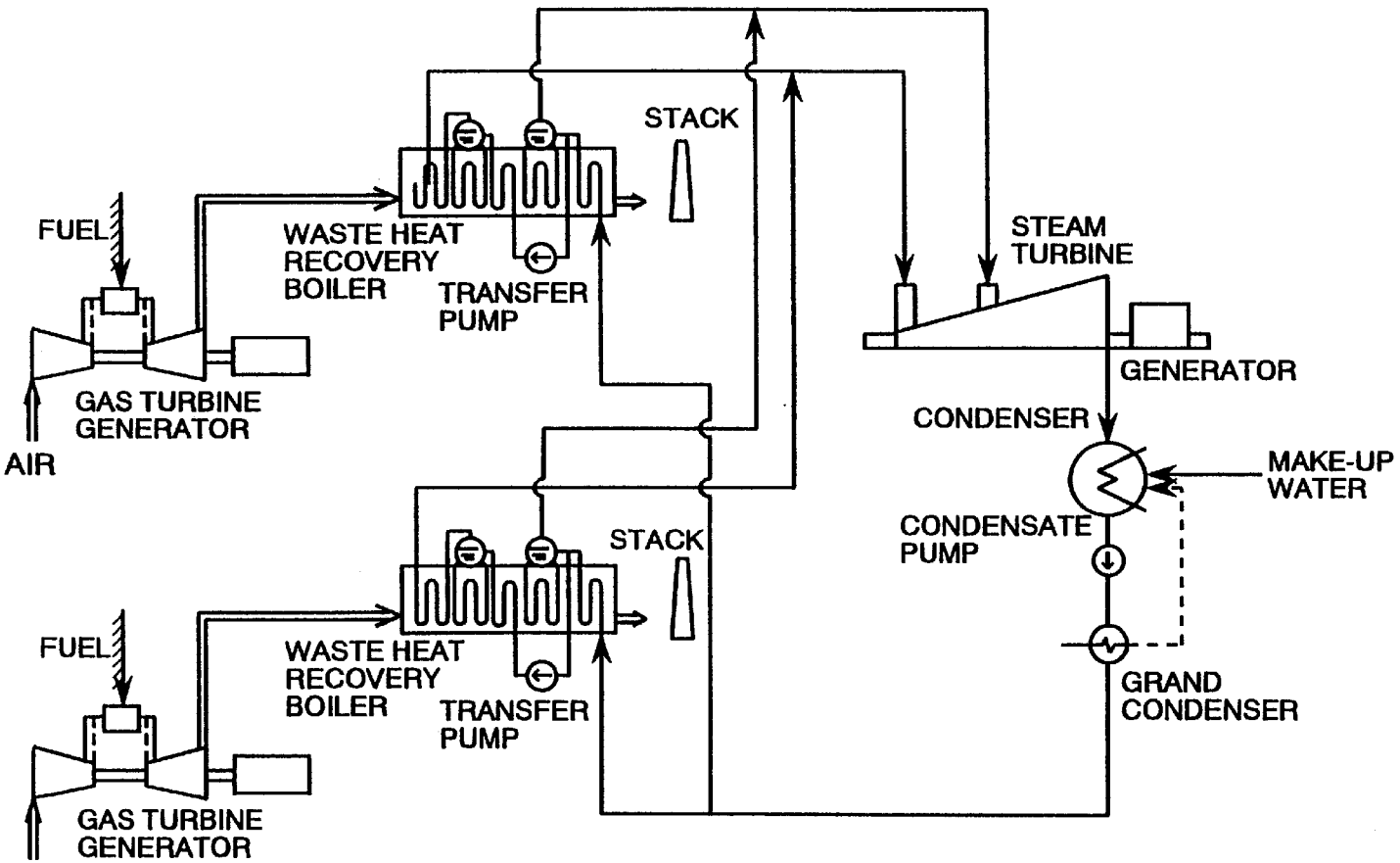
FIG. 18 is a diagram showing a combined cycle power generation system.

FIG. 18 is a schematic diagram of a multi axis type combined cycle power generation system employing both of 2 gas turbines and one high and low pressure integral steam turbine.

In a case where electric power is generated using a gas turbine, in recent years there has been a tendency to use a compound power generation system in which the gas turbine is driven with liquified natural gas (LNG) as fuel, a steam turbine is driven with steam obtained by recovering energy of waste or exhaust gas of the gas turbine, and a generator is driven by the gas turbine and the steam turbine. By using the compound power generation system, the thermal efficiency can be improved greatly to be about 44% as compared with a conventional single steam turbine power generation of which the thermal efficiency is 40%.

In such a compound power generation plant, recently, further, use of both of liquid natural gas(LNG) and liquid petroleum gas (LPG) is planned instead of use of only LNG, and a smooth operation of plant and improvement of economy are planned by combustion of both of LNG and LPG.

In the power generation system, first of all, air is transferred to an air compressor of the gas turbine through an inlet air filter and inlet air silencer, and the air compressor compresses the air and transfers the compressed air into low NOx combustors.

In the combustors, fuel is injected into the compressed air and burned to generate high temperature gas of 1200° C. or more and the gas works in the gas turbine to generates power.

Exhaust gas of 530° C. or more from the gas turbine is transferred into an exhaust or waste gas recovery boiler through an exhaust gas silencer. The boiler recovers energy of the exhaust gas to generate high pressure steam of 530° C. or more. The boiler is provided with a denitration apparatus using a dry type ammonia contact reducing system. The exhaust gas is exhausted from a several hundreds meters high stack with a tripod.

The generated high pressure steam and low pressure steam are transferred to the steam turbine having a high and low pressure integral rotor. The turbine is described later.

Further, the steam from the steam turbine flows into a condenser, in a which it is deaerated in vacuum to be condensate. The condensate is pressurized by a condensate pump, and sent to the boiler as a feed water. The gas turbine and the steam turbine drives the generator at both shaft ends of the generator to generate electric power. For cooling gas turbine blades used in such a compound power generation plant, in some cases, steam used in the steam turbine may be used as a cooling medium.

Generally, air is used as a coolant for blades. However, steam also is used as such a coolant. Steam has a large cooling effect because the steam has a drastically large specific heat as compared with air and has light weight. Since the steam has a large specific heat, the temperature of a main flow gas is reduced remarkably and the thermal efficiency of the whole plant is increased when the steam used as coolant is flowed into the main flow gas, so that steam of relatively low temperature (for example, about 300–400° C.)is supplied to turbine blades from coolant supply ports, cools blade bodies, the coolant the temperature of which is elevated to relatively high temperature through heat-exchange is recovered and then returned into the steam turbine. Thereby a decrease in the temperature (about 1300–1500° C.) of the main flow gas is prevented and the efficiency of the steam turbine is raised, whereby the efficiency of the whole plant can be improved. By this multi-axis type combined power generation system, 100,000–500,000 kW in total can be generated, wherein the gas turbine can generate 50,000–300,000 kW and the steam turbine 50,000–200,000 kW. Thereby, the steam turbine in the embodiment is made compact and all the plant including a plurality of gas turbines and steam turbine can generate power of 700,000–1,000,000 kW. The plant having the same capacity as a large-sized steam turbine can be made at low cost, compared with the large sized steam turbine and has a large merit that the turbine can be effectively or ecomonically operated responding to fluctuation in power generation amount.

Figure 19:
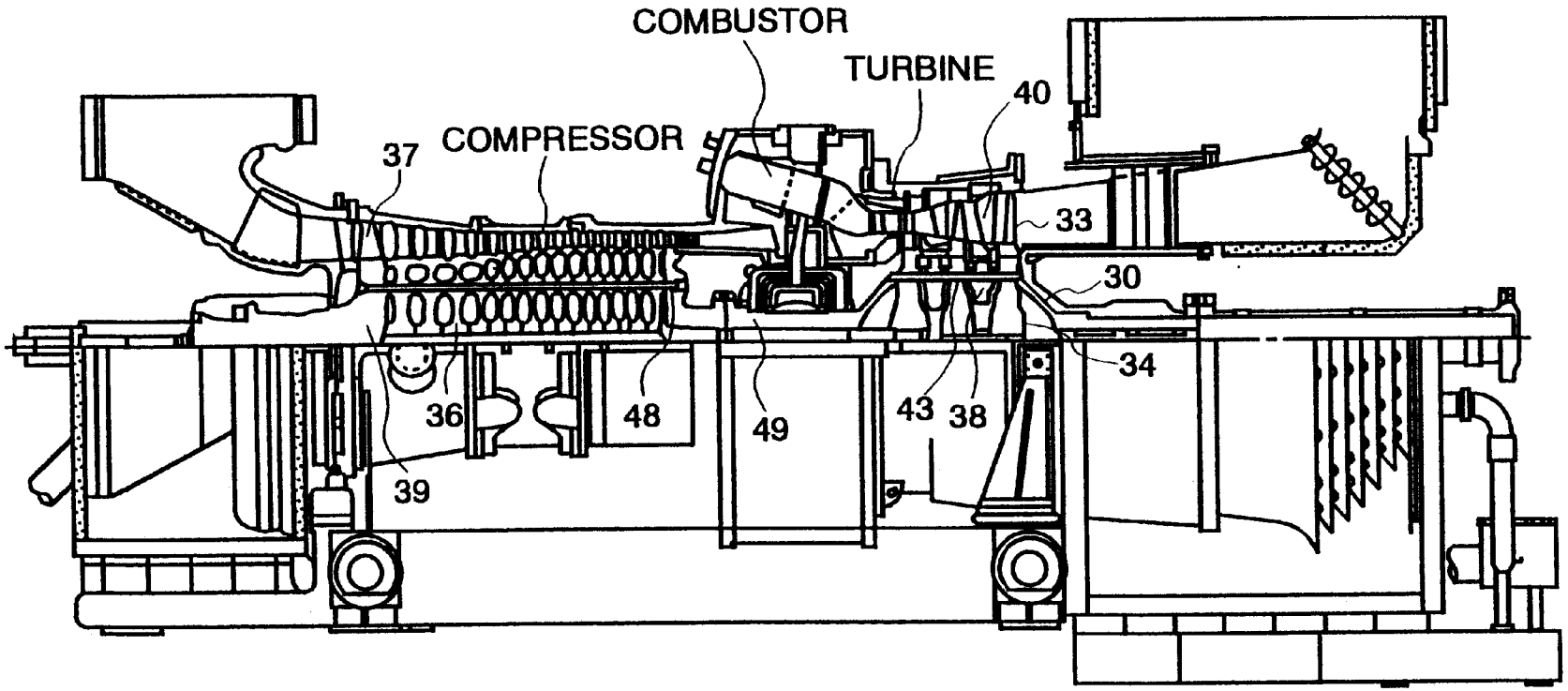
FIG. 19 is a sectional view of a gas turbine.

FIG. 19 a sectional view of a rotation part of the gas turbine in this embodiment.

Reference number 30 denotes a turbine stub shaft, 33 turbine blades, 43 turbine stacking bolts, 38 turbine spacers, 39 distant pieces, 40 turbine nozzles, 36 compressor discs, 37 compressor blades, 48 compressor stacking bolts, 39 compressor stub shafts and 34 turbine discs. The gas turbine according to the embodiment of the present invention has compressor discs 36 arranged in 17 stages, and the turbine blades 33 may be arranged in 2–4 stages.

The gas turbine of this embodiment has nozzles and blades each arranged in 3 stages. A first stage nozzle 33(*a*) and first stage blade 33(*a*) have the same blade portion length along a combustion gas flow an gas inlet side as that at outlet side, however, blade portion length of each of 2 and 3 stage nozzles and blades at the gas outlet side is longer than that at the gas inlet side. The length of the second stage nozzles at the gas outlet side have 1.25–1.45 times that at the gas inlet side, and the length of the second stage blades at the gas inlet side have 1.0–1.2 times that at the gas outlet side. The length of the third stage nozzles at the gas outlet side have 1.1–1.3 times that at the gas inlet side, and the length of the third stage blades at the gas inlet side have 1.00–1.05 times that at the gas outlet side. An axial distance between the nozzle and blade at the second stage is 1.85–2.05 times that at the first stage and a similar distance at the third stage is 2.3–2.5 times that at the first stage.

The turbine blades each have a blade portion, a platform, a shank and an inverted Christmas-tree shaped dovetail which is a planting or mounting portion at which the blade is planted or mounted into the turbine disc. Each turbine blade has seal fins 41 provided on the shank portion and, a cooling hole for air or steam cooling inside. The cooling hole is formed at the first stage so that a coolant goes into the outside out of the blade tip and the trailing edge, and at the second stage so that the coolant goes out of the tip portion. As for the seal fins 41, two fins are provided at each side at the first stage and one fin is provided at each side at each of the second and third stages. A seal member having 2 projections is provided on blades at each of the second and third stage so that sliding relative to a shroud is smoothly effected.

The turbine nozzle 40 at the first stage has a cooling hole formed so that a coolant goes into the outside through the leading edge and trailing edge and a laminar flow is formed on the surface of the blade. The blade at the second stage has a cooling hole formed so that the coolant goes out at the trailing edge. The blade at the third stage has no cooling hole, however, it is preferable to provide a cooling hole in the same manner as in the second stage in a case where the temperature of combustion gas becomes 1300° C. or more.

The gas turbine in this embodiment takes, a main type, a heavy duty type and a uni-axial type, and includes a horizontally split casing and a stacking type rotor, the compressor takes a 17 stage axial flow type, the turbine blade takes a 3 stage impulse type and 1, 2 stage air cooling stationary and moving blades, and the combustor takes a birth flow type, 16 cans and slot cool type.

With the materials listed in table 11, a large sized steel lump corresponding to a practical product was melted by an electroslag melting method, forged and then heat-treated. The forging was done in a range of 850–1150° C., the heat treatment was done under the conditions shown in the table 10. The table 11 shows chemical compositions (by weight percentage) of samples. As for microscopic structures of those materials, Nos. 60–63 each are wholly tempered martensite structure, Nos. 64 and 65 each are wholly tempered bainitic structure. No.60 is used for distant piece and final stage compressor disc, the former is formed in thickness 60 mm×width 500 mm×length 1000 mm, and the latter in diameter 1000 mm×thickness 180 mm. No. 61 is used in disc and formed in diameter 1000 mm×thickness 180 mm. No. 62 is as spacer formed outer diameter 1000 mm×inner diameter 400 mm×thickness 100 mm. No. 63 is used as stacking bolts of each of the turbine and compressor formed in diameter 40 mm×length 500 mm, and bolts connecting the distant piece and the compressor disc also are formed using the material of No. 63. Nos. 64 and 65 are as turbine stub shaft and compressor stub shaft each forged and extended in diameter 259 mm×length 300 mm. Futher, an alloy of No. 64 is used for compressor discs 6 of 13–16 stages and steel of No. 65 is used for compressor discs 6 of the first stage to 12th stage. Any of them are produced in the same size as the turbine disc. Test pieces after heat treatment are taken in a perpendicular direction to the axial (length) direction except No. 63. No. 63 test piece is taken in the axial direction.

TABLE 11

| Samp. | Compositions (wt %) | | | | | | | | | | Heat |
|---|---|---|---|---|---|---|---|---|---|---|---|
| No. | C | Si | Mn | Cr | Ni | Mo | V | Nb | N | Fe | treatment |
| 60 (Distant piece) | 0.10 | 0.04 | 0.70 | 11.58 | 1.98 | 1.98 | 0.20 | 0.08 | 0.06 | bal. | 1050° C. × 5 hOQ<br>550° C. × 15 hAC<br>600° C. × 15 hAC |
| 61 (Turbine disc) | 0.10 | 0.05 | 0.65 | 11.49 | 1.70 | 2.04 | 0.19 | 0.08 | 0.06 | " | 1050° C. × 8 hOQ<br>550° C. × 20 hAC<br>600° C. × 20 hAC |
| 62 (Spacer) | 0.09 | 0.07 | 0.59 | 11.57 | 2.31 | 2.22 | 0.18 | 0.09 | 0.06 | " | 1050° C. × 3 hOQ<br>550° C. × 10 hAC<br>600° C. × 10 hAC |
| 63 (Stacking bolt) | 0.10 | 0.03 | 0.69 | 11.94 | 1.86 | 2.25 | 0.21 | 0.15 | 0.05 | " | 1050° C. × 3 hOQ<br>550° C. × 2 hAC<br>600° C. × 2 hAC |
| 64 Cr—Mo—V steel | 0.26 | 0.25 | 0.79 | 1.09 | 0.41 | 1.25 | 0.23 | — | — | " | 975° C. × 8 hWQ<br>665° C. × 25 hAC<br>665° C. × 25 hAC |
| 65 Ni—Cr—Mo—V steel | 0.20 | 0.21 | 0.36 | 1.51 | 2.78 | 0.62 | 0.10 | — | — | " | 840° C. × 8 hWQ<br>635° C. × 25 hAC<br>635° C. × 25 hAC |

It was confirmed from Nos. 60–63 (12 Cr steel) that a 450° C. $10^5$ h creep rupture strength is 51 kg/mm$^2$ or more, a 20° C. V-notch Charpy impact value is 7 kg-m/cm$^2$ or more, and a necessary strength for high temperature gas turbine material is satisfied.

Nos. 64 and 65 (low alloy steel) for the stub shaft each are low in a 450° C. $10^5$ h creep rupture strength, but they each have a tensile strength of 86 kg/mm$^2$ or more and a 20° C. V-notch Charpy impact value of 7 kg-m/cm$^2$ or more, whereby it was confirmed that a necessary strength (tensile strength≧81 kg/mm$^2$ and 20° C. V-notch Charpy impact value≧5 kg-m/cm$^2$)required for the stab shaft was sufficiently satisfied.

Under such conditions, the temperature of the distant piece and the temperature of the final stage compressor disc each become 450° C. at maximum. The thickness is preferable to be 25–30 mm for the former and 40–70 mm for the latter. The turbine disc and compressor disc each have a through hole formed at the center, and the turbine disc has compression remaining stresses at the through hole.

Further, in the gas turbine of the present invention, the turbine spacer 34, distant piece 49 and compressor disc 36, at the final stage each were made of heat resistant steel of a wholly tempered martensite steel comprising, by weight, 0.12% C, 0.04% Si, 0.21% Mn, 11.10% Cr, 2.55% Ni, 2.03% Mo, 0.04% Nb, 0.23% V and 0.05% V. As a result, the following is possible, that is, a compression ratio is 14.7, a temperature of 350° C. or more, a compression efficiency of 86 or more, and a gas temperature of 1260° C. or more at the first stage nozzle inlet, whereby a thermal efficiency of 32% or more can be attained, and a creep rupture strength as mentioned above and a high impact value after embrittling heating also can be obtained, and a gas turbine of higher reliability can be obtained.

The turbine discs 34 are arranged in 3 stage, the discs in the first and second stages from an upstream side of a gas flow each have a central hole. Further, in this embodiment, the compressor disc 36 at the final stage at a downstream side of the gas flow, the distant piece 49, the turbine spacer 38, the turbine stacking bolts 43 and the compressor stacking bolts 48 each are made of the heat resistant steel shown in the table 12. The other turbine blades 33, turbine nozzles 40, a combustor liner, compressor blades 37, compressor nozzles, a diaphragm and shrouds each are constructed with the alloy shown in the table 12. In particular, the turbine nozzles 40 and the turbine blades 33 are constructed with casting.

The turbine blades 33 in the first stage each are made of a Ni-base alloy comprising, by weight, 0.15–0.20% C, not more than 0.5% Si, not more than 0.5% Mn, 15–17% Cr, 7.5–9.5% Co, 1.5–2.5% Mo, 0.005–0.015% B, 2.1–3.0% W, 3–4% Ti, 3–4% Al, 0.5–1.5% Nb, not more than 0.2% Zr and 1.5–2.5% Ta, and the turbine blades 33 in the second and third stages each are made of a Ni-base alloy comprising, by weight, 0.10–0.20% C, not more than 0.5% Si, not more than 0.5% Mn, 14–16% Cr, 8–10% Co, 2.5–3.7% Mo, 0.01–0.02% B, 2.5–4.5% W, 3.5–4.5% Ti, 4–6% Al and not more than 0.1% Zr, and those alloys each are preferable to include γ' phase in γ phase.

For the turbine nozzles, the alloys shown in the table 12 are preferable, that is, a Ni-base alloy in the first stage, and a Co-base forging alloy in the second and third stages. The first stage has one blade portion, the second and third portions each have two blade portion. All the stages each can be one blade portion.

The compressor discs 36 can be split type in which they are separated according to one series of the blades and integrated into one, split type in which 3 to 5 series are made into one piece, and one piece type in which all parts are made into one piece. As material for them, the material used for the steam turbine rotor shaft can be used. This embodiment also can be achieved in the same manner.

In the table 12, shroud segments (1) are used for the first stage at an upstream side of the gas flow, shroud segments (2) are used for the second and third stages.

TABLE 12

| | | C | Si | Mn | Cr | Ni | Co | Fe | Mo | B | W | Ti | Others |
|---|---|---|---|---|---|---|---|---|---|---|---|---|---|
| Tarbine blade | 1 stage | 0.17 | 0.3 | 0.3 | 16.01 | bal. | 8.50 | — | 1.75 | 0.010 | 2.60 | 3.40 | Nb0.89, Al3.40, Zr0.10, Ta1.75 |
| | 2, 3 st. | 0.15 | 0.11 | 0.12 | 15.00 | bal. | 9.02 | — | 3.15 | 0.015 | 3.55 | 4.11 | Zr0.05, Al5.00 |
| Turbine | 1 stage | 0.10 | — | — | 20.2 | " | 21.5 | — | — | 0.007 | 7.55 | 2.32 | Al1.18, Ta0.98, Nb0.78 |
| nozzle | 2, 3 st. | 0.43 | 0.75 | 0.68 | 29.16 | 10.18 | bal. | — | — | 0.010 | 7.11 | 0.23 | Mb0.21, Zr0.15 |
| Combustor liner | | 0.07 | 0.83 | 0.75 | 22.13 | bal. | 1.57 | 18.47 | 9.12 | 0.008 | 0.78 | — | — |
| Compressore blade, nozzle | | 0.11 | 0.41 | 0.61 | 12.07 | 0.31 | — | bal. | — | — | — | — | — |
| Shroud segment | (1) | 0.08 | 0.87 | 0.75 | 22.16 | bal. | 1.89 | 18.93 | 9.61 | 0.005 | 0.85 | — | — |
| | (2) | 0.41 | 0.65 | 1.00 | 23.55 | 25.65 | — | bal. | — | — | — | 0.25 | Nb0.33 |
| Daiphragm | | 0.025 | 0.81 | 1.79 | 19.85 | 11.00 | — | " | — | — | — | — | — |

The liner, blades and stationary vanes each are provided, at a portion contacting with flames, a heat shielding layer of $Y_2O_3$ stabilized zirconia thermal spraying layer. In particular, an alloy layer is formed between the base metal and the coating layer, the alloy layer comprising, by weight, 2–5% Al, 20–30% Cr, 0.1–1% Y and balance Ni or (Ni+Co).

With the above construction, it is possible that a compression ratio is 14.7, a temperature 350° C. or more, a compression efficiency 86% or more, a first stage turbine nozzle inlet gas temperature 1260° C. or more and an exhaust gas temperature 530° C. or more, and a thermal efficiency of 32% or more can be obtained. Further, the heat resistant steel of a high creep rupture strength and a small embrittleness by heating, as mentioned above, is used for the turbine discs, distant pieces, spacers, compressor discs, in the final stage, and stacking bolts, a high high-temperature strength alloy is used for the turbine blades, a high high-temperature strength and high-temperature elongation is used for the turbine nozzles, and a high strength and fatigue resisting strength alloy is used for the combustor liner, so that a gas turbine of high reliability and well balanced as a whole can be obtained. Natural gas, light oil is used as used fuel.

Although most of gas turbines each have an intercooler, particularly, the present invention is suitable for the turbines which have no intercooler and the nozzles heated to a high temperature. In this embodiment, about 40 turbine nozzles are arranged in a full periphery in the first stage.

The gas turbine nozzles are cast by a casting mould. The mould is formed by immersing a wax mould in a liquid which acrylic resin is dissolved in methyl ethyl ketone, drying by air blowing and then immersing it in a slurry (zircon flower+colloidal silica+alcohol) and blowing stack (first layer of zircon sand, second or other layer of shamotte sand) and repeating it several times. The mould is heated to 900° C. after removing wax therefrom.

The mould is mounted in a vacuum furnace, an alloy of the compositions of the sample No. 7 is melted by vacuum melting, and poured in the mould in the vacuum. In the cast nozzle of the first stage, formed in this manner, the width of a blade portion between side walls is about 74 mm, the length 110 mm, the most thick portion 25 mm and the thickness 3–4 mm, and a slit of about 0.7 mm is provided at the tip for air passage. The nozzle in this embodiment is provided with holes for pin-fin cooling, impingement cooling and film cooling. The thickness of the slit portion at the tip is about 1 mm. The nozzle formed in this manner is subjected to solid solution treatment, and aging treatment in a non-oxidizing atmosphere.

The nozzles of the first, second and third stages, of the present embodiment, each are made as shown in the table, but the nozzles of the second and third stage each also can be formed by 2 vane portions of Ni-base alloy in the same manner. The nozzle of the first stage is restrained at both ends but the nozzles of the second and third stage are restrained at only one end. The nozzles of second and third stages each have a wider blade portion than the nozzle of the first stage.

A pipe of SUS304 stainless steel having holes for impingement cooling is welded by TIG welding all over the periphery of the body so that a cooling air entered into the pipe does not leak at the welded portions. The nozzle has cooling air out-going holes provided inside at a combustion gas outlet side.

The nozzles of the first stage each have a structure that it is restrained at both ends of the side wall, but the nozzles of the second or other stages other than the first stage each have a structure that the nozzles is restrained at one side of at an outer peripheral side of the side wall.

Further, as a plant construction, 6 power generation systems, one of which comprises one gas turbine, one exhaust heat recovery boiler, one steam turbine and one generator, can be combined into a one-axis type power generation plant.

In this embodiment, the system is a multi-axis type system composed of two gas turbines, and one steam turbine, but such a multi-axis type system can be constructed that each of 4–6 gas turbines generates power and steam from exhaust heat recovery boilers which are installed for the gas turbines, respectively, and collected in one steam turbine to rotate and generate power.

In the gas turbine, air is compressed, and LNG is burnt in the compressed air to generate high temperature gas by which the turbine is driven.

The exhaust heat recovery boiler recovers effectively heat of the combustion gas from the gas turbine and generates steam. The steam is introduced to the steam turbine and drives the generator.

Power generation is allotted such that the gas turbine outputs about ⅔ of the whole output and the remaining output, ⅓ is generated by the steam turbine.

The above-mentioned compound power generation system has the following effects.

The thermal efficiency is improved by 2–3%, compared with a conventional fossil fuel power generation. Further, even at the time of a partial load, by decreasing the number of gas turbines in operation, equipments in operation each can be operated around rated load at which a high thermal efficiency operation is possible, so that the plant can maintain a high thermal efficiency as a whole.

The compound power generation system is constructed of a gas turbine which can easily start and stop in a short time, and a compact and simple steam turbine. Therefore, output can be easily adjusted and it is most suitable for middle load power generation in response to change in power demand.

Reliability of the gas turbine has been increased remarkably by recent developments in technology. Since the compound power generation plant is composed of a plurality of small capacity machines, even if a trouble occurs, the influence of the trouble can be restricted to a local part. Therefore, it is an electric source of high reliability.

Output allotted to a steam turbine of the compound power generation plant is small, that is, about ⅓ of the output of the whole plant, so that an amount of exhausted hot water is about 70% of that of conventional plant of the same capacity.

EMBODIMENT 7

This embodiment has the following requirement in stead of the gas turbine of the embodiment 6.

In a gas turbine of this embodiment, first stage blades 33 each have substantially the same construction as in the embodiment 6, and are made of a unidirectional solidification casting of Ni-base super alloy comprising, by weight, 5–16% Cr, 0.3–2% Mo, 2–9% W, 2.5–6% Al, 0.5–5% Ti, 1–4% Ta, 8–10% Co, 0.05–0.15% C, 0.005–0.02% B, inevitable impurity and balance Ni. A total length of each first stage blade is about 220 mm. Since a service temperature of the unidirectional solidification casing is 890–900° C. at $10^5$ h 14 kgf/mm$^2$, a heat shield coating layer is provided to lower the metal temperature of the material as in the embodiment 6. The unidirectional solidification is done gradually from the blade portion toward a dovetail portion to form columnar crystal of the diameter 2–10 mm. The crystal is small at the blade portion and becomes larger from a shank portion to the dovetail portion. The unidirectional solidification casting is subjected to solid solution treatment at 1200–1280° C., and then two step aging treatment at 1000–1150° C. and at 800–950° C. is effected, whereby 50–70 volume % of γ phase of one side 2 μm or less is precipitated. Particularly, it is preferable to precipitate 60–65 vol %.

As second stage blades 33 and third stage blades 33, the same blades as in the embodiment 6 are used.

The first stage nozzles 49 each are made of a similar alloy to one in the embodiment 6, but the heat shield coating layer has the following structure. The heat shield coating has 4 layers formed. They are, from the surface to the matrix in turn, a $Y_2O_3$-stabilized zirconia thermal spraying layer, an alloy layer, a mixture layer of ceramics and alloy, and an alloy layer. The coating layer has the functions of heat shielding, thermal stress damping and corrosion resistance. The coating layer is composed of an alloy including, by weight, 2–5% Al, 20–30% Cr, 0.1–1% Y and balance Ni or (Ni+Co).

The second and third nozzles 40 also are made of a Ni-base supper alloy comprising, by weight, 21–24% Cr, 18–23% Co, 0.05–0.20% C, 1–8% W, 1–2% Al, 2–3% Ti, 0.5- 1.5% Ta, 0.05–0.15% B, inevitable impurity and balance Ni. The heat shield layer is unnecessary to be provided, particularly, however, the second stage is provided with an alloy layer of an alloy comprising by weight 2–5% Al, 20–30% Cr, 0.1–1% Y and balance Ni or Ni+Co to improve corrosion resistance. Each nozzle has an inner cooling hole, and it is cooled by compressed air. A durability temperature in those materials at $10^5$ hours 6 kgf/mm$^2$ is 840–860° C.

In this embodiment, for the turbine discs 34, turbine stub shaft 30 and turbine stacking bolts 43, a heat resistant steel is used, which comprises by weight 0.05–0.2% C, not more than 0.5% Si, not more than 1% Mn, 8–13% Cr, not more than 3% Ni, 1.5–3% Mo, 0.05–0.3% V, 0.02–0.2% Nb, 0.02–0.1% N and balance substantially Fe and wholly tempered martensite structure. The steel has a 450° C. $10^5$ h creep rupture strength of 50 kgf/mm$^2$ or more and a 20° C. V-notch Charpy impact value of 7 kg-m/cm$^2$ or more, and a strength necessary for high-temperature gas turbine materials is satisfied. Further, the above-mentioned heat resistant steel has ferritic crystal structure, but ferritic materials are small in heat expansion rate, compared with austenitic materials. In the present embodiment using heat resistant steels, heat expansion rate of the disc material is smaller than in the embodiment 6 using a Ni-base alloy for the turbine discs. Therefore, thermal stresses generated in the discs can be reduced, and occurrence of cracking and rupture can be suppressed.

The compressor blades are arranged in 17 stages, and an air compression ratio of 18 can be obtained thereby.

As fuel, LNG and light oil are used.

With the above-mentioned construction, a gas turbine which is high in reliability and well balanced, as a whole can be obtained. A gas inlet temperature to the first stage turbine nozzles is 1500° C., a metal temperature of the first turbine blades is 900° C., and an exhaust gas temperature of the gas turbine is 650° C. A gas turbine for electric power generation having a power generation efficiency of 37% or more, expressed by LHV can be achieved.

What is claimed is:

1. A high and low pressure sides integrating steam turbine for 50 Hz power generation, comprising a rotor having a mono-block rotor shaft with blades mounted thereon in multi-stages from a high pressure side to a low pressure side, and a casing covering said rotor, wherein blades of at least a final stage each have blade portion length of 41.7 inches or more and are made of martensite stainless steel, said martensite stainless steel having a 20° C. V-notch sharpy impact value of 2.5 kgm/cm$^2$ or more and room-temperature tensile strength of 120 kg/mm$^2$ or more, and said impact value (kgm/cm$^2$) being not less than a value obtained by (−0.6x+77.2) when said room-temperature tensile strength (kg/mm$^2$) is denoted by x.

2. A high and low pressure sides integrating steam turbine for 60 Hz power generation, comprising a rotor having a mono-block rotor shaft with blades mounted thereon in multi-stages from a high pressure side to a low pressure side, and a casing covering said rotor, wherein blades of at least a final stage each have blade portion length of 34.7 inches or more and are made of martensite stainless steel, said martensite stainless steel having a 20° C. V-notch sharpy impact value of 2.5 kgm/cm$^2$ or more and room-temperature tensile strength of 120 kg/mm$^2$ or more, and said impact value (kgm/cm$^2$) being not less than a value obtained by (−0.6x+77.2) when said room-temperature tensile strength (kg/mm$^2$) is denoted by x.

3. A high and low pressure sides integrating steam turbine according to claim 1, wherein said martensite stainless steel comprises by weight percentage, 0.08–0.18% C, not more than 0.25% Si, nor more than 1.00% Mn, 8.0–13.0% Cr, 2–3% Ni, 1.5–3.0% Mo, 0.05–0.35% V, 0.02–0.20% in total of at least one kind of Nb and Ta, and 0.02–0.10% N.

4. A high and low pressure sides integrating steam turbine for 50 Hz power generation, comprising a rotor having a mono-block rotor shaft with blades mounted thereon in multi-stages from a high pressure side to a low pressure side, and a casing covering said rotor, said rotor shaft being made of a low alloy steel comprising, by weight percentage, 0.18–0.28% C, not more than 0.1% Si, not more than 0.1–0.3% Mn, 1.5–2.5% Cr, 1.5–2.5% Ni, 1–2% Mo and 0.1–0.35% V, said high pressure portion having 538° C.–105 h flatness-and notch-creep rupture strength of not less than 13 kg/mm$^2$, and said low pressure portion having a tensile strength of not less than 84 kg/mm$^2$ and a 50% fracture appearance transition temperature of not more than 35° C., blades of at least a final stage each being made of martensite stainless steel comprising by weight percentage, 0.08–0.18% C, not more than 0.25% Si, not more than 0.90% Mn, 8.0–13.0% Cr, 2–3 Ni, 1.5–3.0% Mo, 0.05–0.35% V, 0.02–0.20% in total of at least one kind of Nb and Ta, and 0.02–0.10% N, and room-temperature tensile strength of not less than 128.5 kg/mm$^2$, and having a blade portion length of not less than 43 inches.

5. A high and low pressure sides integrating steam turbine for 60 Hz power generation, comprising a rotor having a mono-block rotor shaft with blades mounted thereon in multi-stages from a high pressure side to a low pressure side, and a casing covering said rotor, said rotor shaft being made of a low alloy steel comprising, by weight percentage, 0.18–0.28% C, not more than 0.1% Si, not more than 0.1–0.3% Mn, 1.5–2.5% Cr, 1.5–2.5% Ni, 1–2% Mo and 0.1–0.35% V, said high pressure portion having 538° C. and 105 h flatness-and notch-creep rupture strength of not less than 13 kg/mm$^2$, said low pressure portion having a tensile strength of not less than 84 kg/mm$^2$ and a 50% fracture appearance transition temperature of not more than 35° C., and blades of at least a final stage each being made of martensite stainless steel comprising by weight percentage, 0.08–0.18% C, not more than 0.25% Si, not more than 0.90% Mn, 8.0–13.0% Cr, 2–3 Ni, 1.5–3.0% Mo, 0.05–0.35% V, 0.02–0.20% in total of at last one kind of Nb and Ta, and 0.02–0.10% N, and room-temperature tensile strength of not less than 128.5 kg/mm$^2$, and having a blade portion length of not less than 35 inches.

6. A high and low pressure sides integrating steam turbine of 50 Hz power generation, comprising a rotor having a mono-block rotor shaft with blades mounted thereon in multi-stages from a high pressure side to a low pressure side, and a casing covering said rotor, wherein an inlet temperature of steam to blades of a first stage is not less than 530° C., said rotor shaft is made of a Ni—Cr—Mo—V low alloy steel of bainitic structure having a higher creep rupture strength at the high pressure side than at said low pressure side, or a higher toughness at said low pressure side than at said high pressure side, and blades of at least a final stage each have a blade-length of not less than 41.7 inches and are made of martensite stainless steel.

7. A high and low pressure sides integrating steam turbine of 60 Hz power generation, comprising a rotor having a mono-block rotor shaft with blades mounted thereon in multi-stages from a high pressure side to a low pressure side, and a casing covering said rotor, wherein an inlet temperature of steam to blades of a first stage is not less than 530° C., said rotor shaft is made of Ni—Cr—Mo—V low alloy steel of bainitic structure having a higher creep rupture strength at the high pressure side than at the low pressure side, or a higher toughness at the low pressure side than at the high pressure side and blades of at least a final stage each have a length of not less than 34.7 inches and are made of martensite stainless steel.

8. A high and low pressure sides integrating steam turbine according to claim 2, wherein said martensite stainless steel comprises, by weight percentage, 0.08–0.18% C, not more than 0.25% Si, not more than 1.00% Mn, 8.0–13.0% Cr, 2–3% Ni, 1.53–3.0% Mo, 0.05–0.35% V, 0.02–0.20% in total of at least one kind of Nb and Ta, and 0.02–0.10% N.

9. A high and low pressure sides integrating steam turbine for 50 Hz power generation, according to claim 1, wherein an inlet temperature of steam to blades of a first stage is not less than 530° C., and said rotor shaft is made of a Ni—Cr—Mo—V low alloy steel of bainitic structure having a higher creep rupture strength at the high pressure side than at the low pressure side or a higher toughness at the low pressure side than at the high pressure side.

10. A high and low pressure sides integrating steam turbine for 60 Hz power generation, according to claim 2, wherein an inlet temperature of steam to blades of a first stage is not less than 530° C., and said rotor shaft is made of a Ni—Cr—Mo—V low alloy steel of bainitic structure having a higher creep rupture strength at the high pressure side than at the low pressure side, or a higher toughness at the low pressure side than at the high pressure side.

* * * * *